United States Patent [19]

Ishikawa et al.

[11] Patent Number: 4,900,651

[45] Date of Patent: Feb. 13, 1990

[54] METHOD FOR PROCESSING SILVER HALIDE COLOR PHOTOGRAPHIC MATERIALS USING A DEVELOPER COMPRISING CHELATING AGENTS, BRIGHTENING AGENTS AND NO BENZYL ALCOHOL

[75] Inventors: Takatoshi Ishikawa; Hiroshi Fujimoto, both of Kanagawa, Japan

[73] Assignee: Fuji Photo Film Co., Ltd., Kanagawa, Japan

[21] Appl. No.: 158,972

[22] Filed: Feb. 22, 1988

[30] Foreign Application Priority Data

Feb. 20, 1987 [JP] Japan ..... 62-37350

[51] Int. Cl.[4] ..... G03C 7/30; G03C 5/24

[52] U.S. Cl. ..... 430/380; 430/434; 430/435; 430/446; 430/464; 430/467; 430/480; 430/484; 430/486; 430/490; 430/491

[58] Field of Search ..... 430/372, 491, 486, 464, 430/434, 435, 490, 567, 446, 484, 486, 517, 522, 380

[56] References Cited

U.S. PATENT DOCUMENTS

| | | | |
|---|---|---|---|
| 3,994,730 | 11/1976 | Frank et al. | 430/491 |
| 4,444,871 | 4/1984 | Miyaoka et al. | 430/486 |
| 4,587,195 | 5/1986 | Ishikawa et al. | 430/372 |
| 4,588,677 | 5/1986 | Ishikawa et al. | 430/387 |
| 4,672,025 | 6/1987 | Yamada et al. | 430/491 |

FOREIGN PATENT DOCUMENTS

| | | |
|---|---|---|
| 59-160142 | 9/1984 | Japan . |
| 59-184341 | 10/1984 | Japan . |
| 60-144739 | 7/1985 | Japan . |
| 61-11745 | 1/1986 | Japan . |

OTHER PUBLICATIONS

"Photographic Developing Compositions" Research Disclosure #17048 (Jun. 1978).

"Use of Sequestering Agents in Black and White Photographic Developers" Research Disclosure #18837 (Dec. 1979).

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A method for processing a silver halide color photographic material is disclosed, which comprises developing a silver halide color photographic material with a color developer comprising:

(a) an aromatic primary amine color developing agent;

(b) at least one brightening agent represented by formula (I)

wherein $R_1$, $R_2$, $R_3$ and $R_4$ each represents a hydroxyl group, an alkoxy group, an amino group, an alkylamino group, an aryloxy group or an arylamino group; provided that $R_1$ is not the same as $R_3$ when $R_2$ is the same as $R_4$, and $R_1$ is not the same as $R_4$ when $R_2$ is the same as $R_3$; and M represents a monovalent cation; and (c) at least one organic phosphonic acid series chelating agent.

17 Claims, No Drawings

METHOD FOR PROCESSING SILVER HALIDE COLOR PHOTOGRAPHIC MATERIALS USING A DEVELOPER COMPRISING CHELATING AGENTS, BRIGHTENING AGENTS AND NO BENZYL ALCOHOL

FIELD OF THE INVENTION

The present invention relates to a method for processing silver halide color photographic materials, and in particular, to a method where the stability of the color developer used is improved and the fluctuation of photographic characteristics and the generation of color stains are noticeably reduced, even in continuous and rapid processing.

BACKGROUND OF THE INVENTION

Color developers containing an aromatic primary amine color developing agent for the formation of color images are known and, at present, play a primary role in the formation of color photographic images. However, aromatic primary amine color developers have the problem that they are oxidized extremely easily by air or metals and it is well known that if a color image is formed using an oxidized developer, fog increases with sensitivity and gradation fluctuates, so that the desired photographic characteristics can hardly be obtained.

In particular, there is lately a tendency toward greater fluctuation of photographic characteristics during continuous processing with the requirement that processing time be shortened and, in some cases, the photographic images formed have a serious problem of being color-stained. This problem is often especially serious when time period for the desilvering step or the step of rinsing with water is shortened.

Various explanations for the fluctuation of photographic characteristics or the generation of color stains in continuous processing have been considered including the following:

(A) The color developer deteriorates with the lapse of time to cause fluctuation of the photographic characteristics along with adhesion of the oxidized product of the developing agent to the photographic materials being processed, generating color stain in the photographic materials.

(B) The color developing agent is carried over into a bleaching solution or bleach-fixing solution bath, where the agent is oxidized, generating fog or color stain.

(C) Substances are dissolved out from the photographic materials being processed into the color developer and accumulate therein, so that those substances adhere to the materials to cause a color stain thereon.

(D) The dyes or sensitizing dyes contained in the photographic materials are not washed out sufficiently, so that the developed materials are colored.

(E) The bleach-fixing solution or the subsequent rinsing solution deteriorates with the lapse of time to cause the generation of color stain.

In order to solve the above-mentioned problems of (A) and (B), an indispensable requirement is to improve the stability of color developers.

Hitherto, various preservatives and chelating agents have been investigated for their ability to improve the stability of color developers. For example, there may be mentioned, as preservatives, the aromatic polyhydroxy compounds described in Japanese patent application (OPI) Nos. 49828/77, 160142/84 and 47038/81 (the term "OPI" as used herein means a "published unexamined Japanese patent application"), U.S. Pat. No. 3,746,544, etc.; the hydroxycarbonyl compounds described in U.S. Pat. No. 3,615,503, British Pat. No. 1,306,176, etc.; the α-aminocarbonyl compounds described in Japanese patent application (OPI) Nos. 143020/77 and 89425/78, etc.; the alkanolamines described in Japanese patent application (OPI) No. 3532/79, etc.; the metal salts described in Japanese patent application (OPI) Nos. 44148/82 and 53749/82, etc. As chelating agents may be mentioned, for example, the aminopolycarboxylic acids described in Japanese patent publication Nos. 30496/73 and 30232/69, etc.; the organic phosphonic acids described in Japanese patent application (OPI) No. 97347/81, Japanese patent publication No. 39359/81, West German Pat. No. 2,227,639, etc.; the phosphonocarboxylic acids described in Japanese patent application (OPI) Nos. 102726/77, 42730/78, 121127/79, 126241/80 and 65956/80, etc.; the compounds described in Japanese patent application (OPI) Nos. 195845/83 and 203440/83, Japanese patent publication No. 40900/78, etc.; the organic phosphonic acid series chelating agents described in *Research Disclosure,* Nos. 18837 (December, 1979) and 17048 (June, 1978), etc.

However, even when the above-mentioned preservatives and chelating agents are used, the improvement of the stability of some color developers is often still insufficient. In particular, when a color photographic material having a silver halide grain emulsion in which 80 mol % or more of silver chloride grains are contained is continuously processed, the result of the continuous processing is often unfavorable in that the processing solution often flocculates or the photographic characteristics of the material would often fluctuate.

On the other hand, to counteract the above-mentioned problems (B) and (D), the technique of adding a 4,4'-diaminostylbene series brightening agent to a color developer to prevent color stain or edge stain of the photographic materials processed has been proposed and described, for example, in *Research Disclosure,* No. 20733 (July, 1981), Japanese patent application (OPI) Nos. 14280/79, 49537/84 and 72444/84, etc. However, all the brightening agents described in the above-mentioned publications have only a small effect and, in addition, they are quite ineffective when processing is carried out using an extremely reduced amount of replenisher for rinsing.

As mentioned above, an effective and sufficient technical means for preventing the fluctuation of photographic characteristics and the generation of color stains in a rapid and continuous processing procedure using a reduced replenisher has not as yet been found and, therefore, there has been a strong desire for an effective and sufficient technical means especially for totally overcoming the above-mentioned problems (A) to (D).

SUMMARY OF THE INVENTION

Accordingly, an object of the present invention is to provide a method for processing photographic materials with a color developer having an improved stability.

Another object of the present invention is to noticeably reduce the fluctuation of photographic characteristics and the generation of color stains in photographic materials continuously processed with the color developer.

These objects have been found to be attained by the provision of a method for processing a silver halide color photographic material, which comprises developing the silver halide color photographic material with a color developer comprising:

(a) an aromatic primary amine color developing agent;

(b) at least one brightening agent represented by formula (I) below; and (c) at least one organic phosphonic acid series chelating agent:

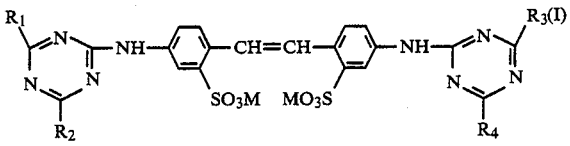

wherein $R_1$, $R_2$, $R_3$ and $R_4$ may be the same or different and each represents a hydroxyl group, an alkoxy group, an amino group, an alkylamino group, an aryloxy group or an arylamino group; provided that $R_1$ is not the same as $R_3$ when $R_2$ is the same as $R_4$ and $R_1$ is not the same as $R_4$ when $R_2$ is the same as $R_3$; and M represents a monovalent cation.

DETAILED DESCRIPTION OF THE INVENTION

Applicants have discovered that when the color developer comprising the combination of the special brightening agent of formula (I) and an organic phosphonic acid series chelating agent is used, the fluctuation of the photographic characteristics of photographic materials processed by continuous processing can noticeably be reduced, which could not be anticipated from the prior art.

In particular, when $R_1$ is the same as $R_3$ when $R_2$ is the same as $R_4$ or when $R_1$ is the same as $R_4$ when $R_2$ is the same as $R_3$, the above-mentioned effect could not be obtained, which could not be anticipated at all.

The effect of the present invention was particularly noticeable in the processing of photographic light-sensitive materials comprising a silver halide grain emulsion in which 80 mol % or more silver chloride grains are contained and was also noticeable when the color developer used is substantially free from benzyl alcohol.

Furthermore, the effect was also noticeable when the subsequent steps after color development (for example, the desilvering step or the water-rinsing or stabilization step) are short, or when the amount of the replenisher added to the water-rinsing or stabilization step is reduced to an extreme degree. Specifically, when the method of the present invention is practiced, the development process no longer requires the rinsing water and the processing time which have heretofore been required by conventional techniques, thereby eliminating to a sufficient degree the staining or coloration remaining of photographic materials being processed.

$R_1$, $R_2$, $R_3$ and $R_4$ of formula (I) may be the same or different and each represents a hydroxyl group, a substituted or unsubstituted alkoxy group having from 1 to 4 carbon atoms (e.g., a methoxy group, an ethoxy group, a methoxyethoxy group, etc.), an amino group, a substituted or unsubstituted alkylamino group having from 1 to 6 carbon atoms (e.g., a methylamino group, an ethylamino group, a propylamino group, a dimethylamino group, a cyclohexylamino group, a β-hydroxyethylamino group, a di(β-hydroxyethyl)amino group, a β-sulfoethylamino group, a N-(β-sulfoethyl)N-methylamino group, a β-carboxyethyl group, etc.), a substituted or unsubstituted aryloxy group (e.g., a phenoxy group, a p-sulfophenyl group, etc.), a substituted or unsubstituted arylamino group (e.g., an anilino group, an o-, m-or p-sulfoanilino group, an o-, m- or p-chloroanilino group, an o-, m- or p-toluidino group, an o-, m- or p-carboxyanilino group, an o-, m- or p-anisidino group, an o-, m- or p-hydroxyanilino group, etc.).

M represents a monovalent cation (e.g., Na, K, etc.).

Examples of the compounds represented by formula (I) which can be used in the present invention are shown below, but these are not intended to limit the scope of the present invention in any way.

I-1

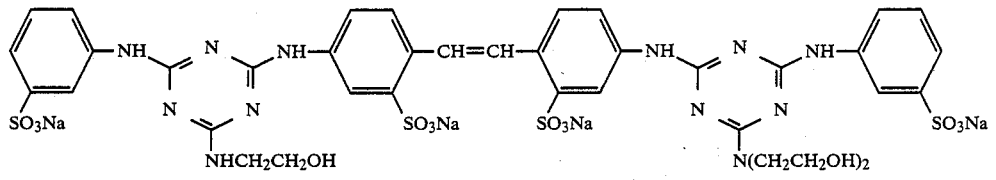

I-2

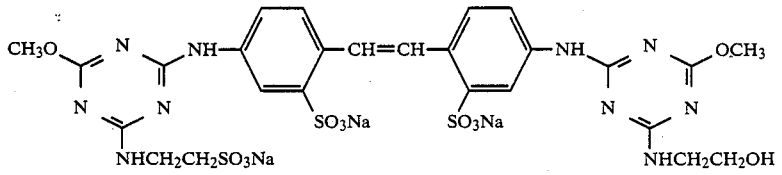

I-3

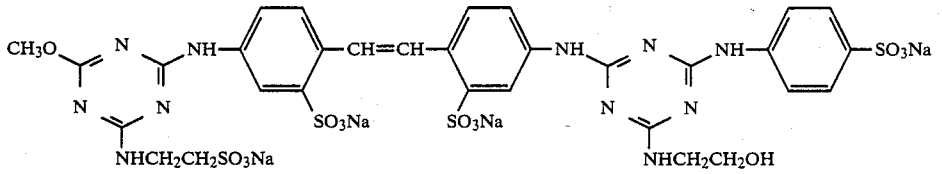

-continued
I-4
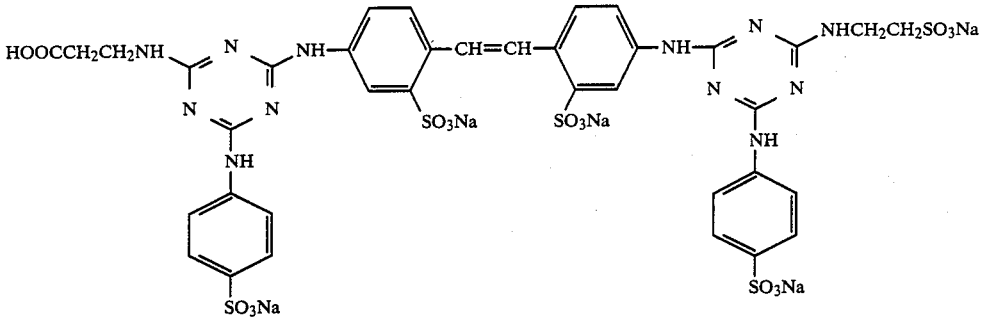
I-5
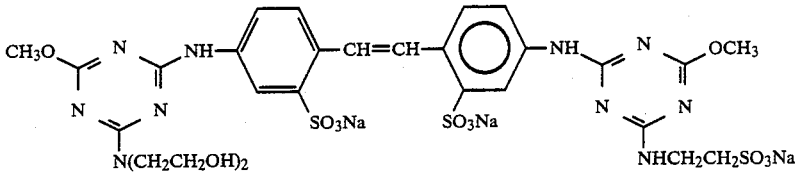
I-6
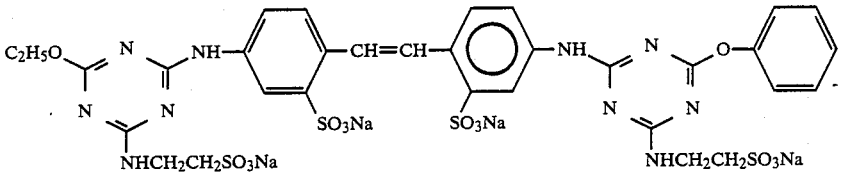
I-7
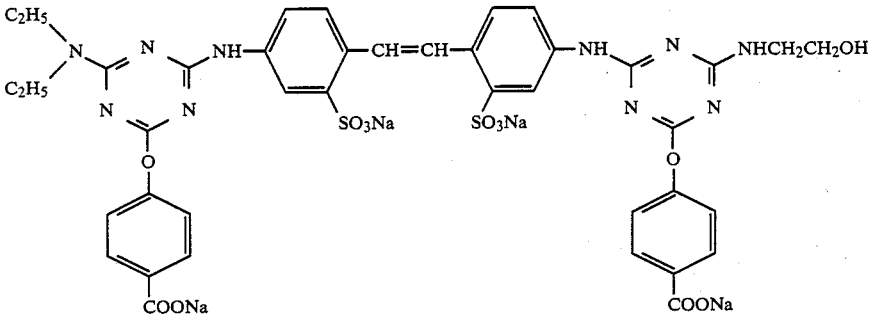
I-8
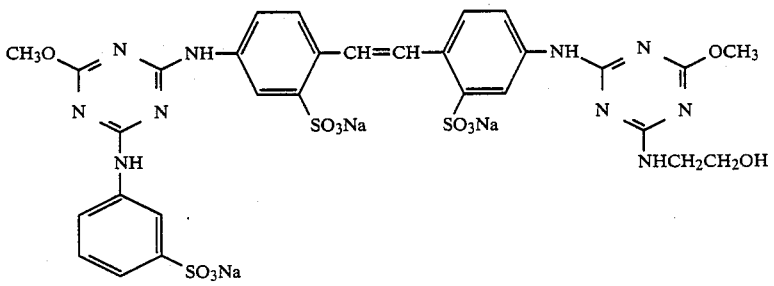
I-9
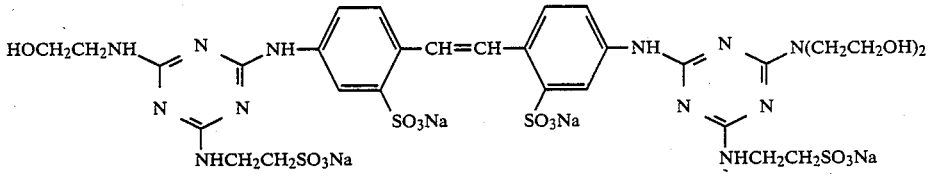

-continued
I-10
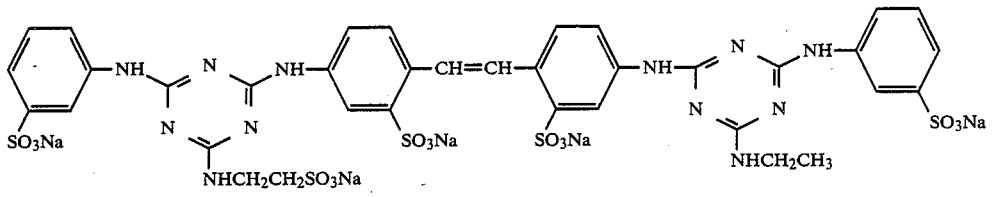
I-11
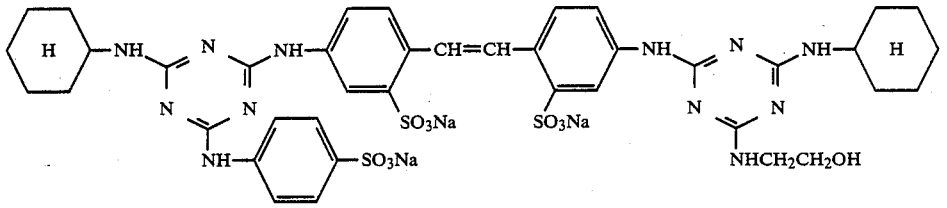
I-12
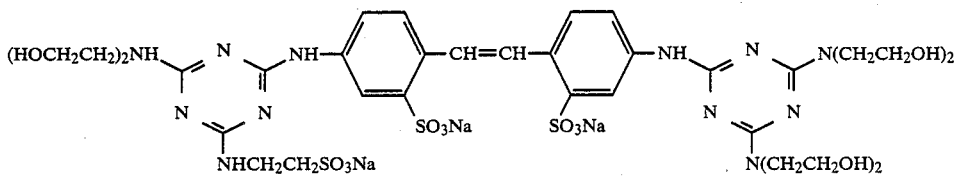
I-13
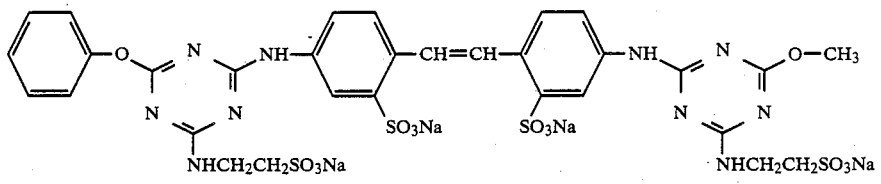
I-14
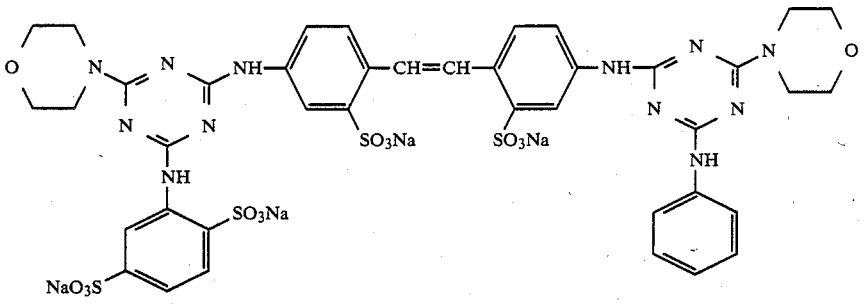
I-15
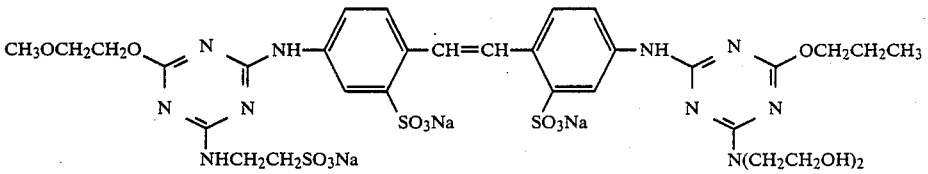
I-16
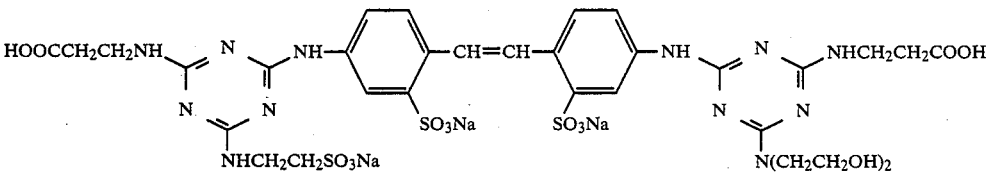

-continued
I-17
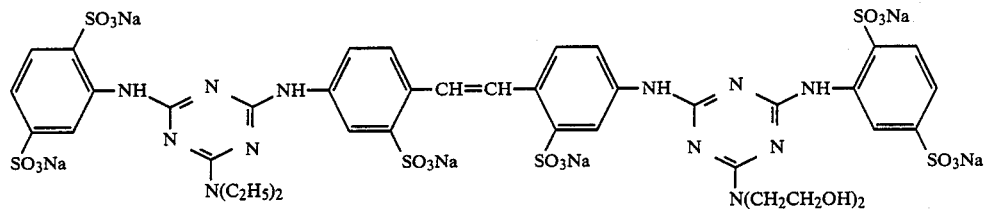
I-18
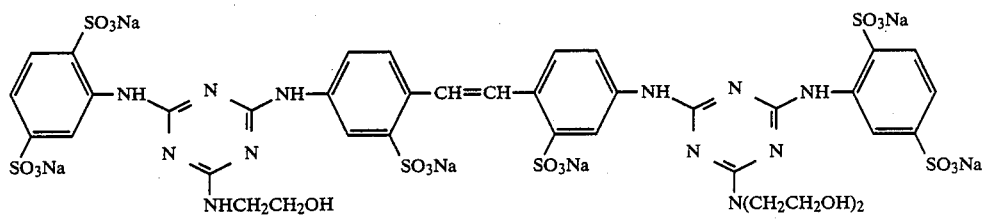
I-19
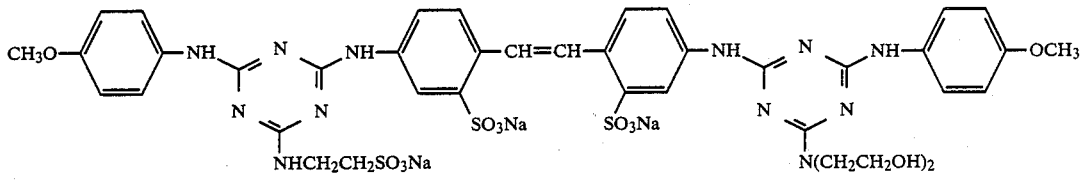
I-20
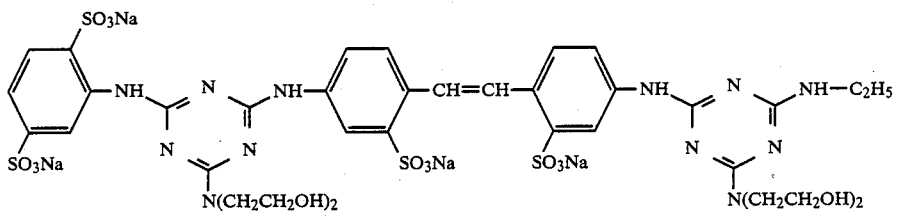
I-21
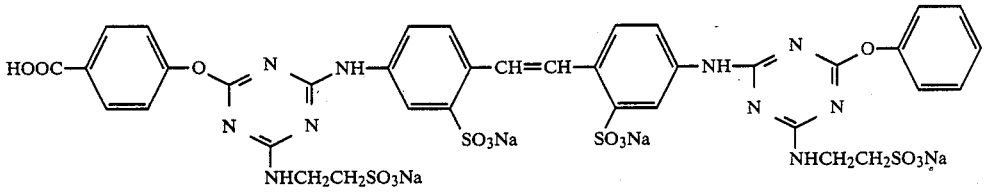
I-22
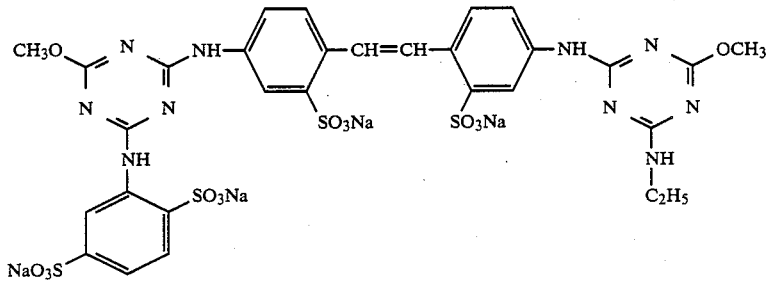
I-23
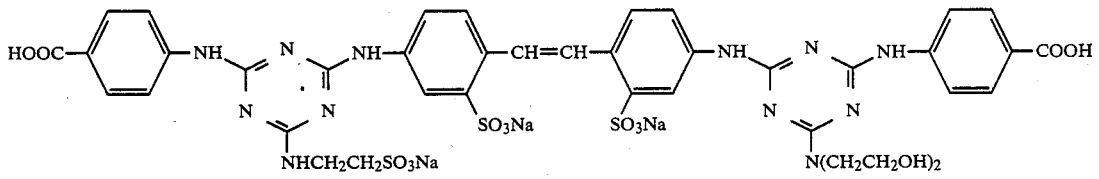

-continued

I-24

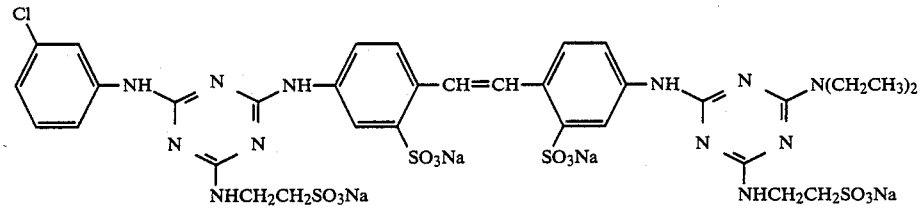

The diaminostilbene series brightening agents for use in the present invention can be produced by conventional methods, for example, as described in *Brightening Agents*, page 8 (edited by Chemical Products Industrial Association, Japan, August, 1976).

The amount of the brightening agent to be added is preferably from 0.1 to 20 g, more preferably from 0.5 g to 10 g, per liter of the color developer.

If desired, two or more brightening agents can be used together.

The organic phosphonic acid series chelating agents for use in the present invention are explained in detail below.

Any organic phosphonic acid can be used in the present invention, including, for example, alkylphosphonic acids, phosphonocarboxylic acids, aminopolyphosphonic acids, etc. These are represented by the following formulae:

$$B-A_1-Z-A_2-C \qquad \text{(II)}$$

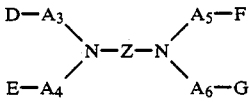

In formulae (II) and (III), $A_1$ to $A_6$ each represents a substituted or unsubstituted alkylene group; Z represents an alkylene group, a cyclohexylene group, a phenylene group, —R—O—R—, —RORORO—,

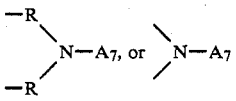

wherein R represents an alkylene group and $A_7$ represents a hydrogen atom, a hydrocarbon residual group, a lower aliphatic carboxylic acid residual group or a lower alcohol residual group; B, C, D, E, F and G each represents —OH, —COOM' or —$PO_3M'_2$, wherein M' represents a hydrogen atom, an alkali metal or an ammonium group, and at least one of B and C and at least one of D, E, F and G are —$PO_3M'_2$.

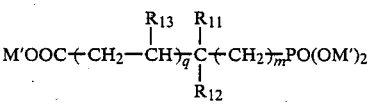

wherein $R_{11}$ represents —COOM' or —$PO(OM')_2$;

$R_{12}$ represents a hydrogen atom, an alkyl group having from 1 to 4 carbon atoms, —$(CH_2)_n$COOM' or a phenyl group;

$R_{13}$ represents a hydrogen atom or —COOM';

M' represents a hydrogen atom, an alkali metal or an ammonium group;

m represents 0 or 1;

n represents an integer of from 1 to 4; and q represents 0 or 1; provided that when m is 0, $R_{11}$ is —$PO(OM')_2$.

$$R_{14}N(CH_2PO_3M'_2)_2 \qquad \text{(V)}$$

wherein $R_{14}$ represents a lower alkyl group, aryl group, aralkyl group or nitrogen-containing 6-membered heterocyclic group, which may be substituted by —OH, —$OR_{15}$ (wherein $R_{15}$ represents an alkyl group having from 1 to 4 carbon atoms), —$PO_3M'_2$, —$CH_2PO_3M'_2$, —$N(CH_2PO_3M'_2)_3$, —COOM' and/or —$N(CH_2COOM')_2$; and M' represents a hydrogen atom, an alkali metal or an ammonium group.

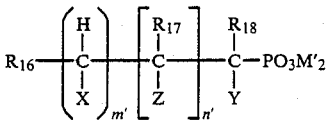

(VI)

wherein $R_{16}$ and $R_{17}$ each represents a hydrogen atom, a lower alkyl group, —COOH or —$NJ_2$, wherein J represents H, OH, a lower alkyl group or —$C_2H_4OH$; $R_{18}$ represents a hydrogen atom, a lower alkyl group, —OH or —$NL_2$, wherein L represents H, OH, —$CH_3$, —$C_2H_5$, —$C_2H_4OH$ or —$PO_3M'_2$; X, Y and Z each represents —OH, —COOM', $PO_3M'_2$ or H;

M' represents a hydrogen atom, an alkali metal or an ammonium group;

n' represents 0 or an integer of 1 or more; and m' represents 0 or 1.

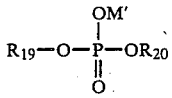

(VII)

wherein $R_{19}$ and $R_{20}$ each represents a hydrogen atom, an alkali metal, an ammonium group, or a substituted or unsubstituted alkyl group, alkenyl group or cycloalkyl group having from 1 to 12 carbon atoms, and M' represents a hydrogen atom, an alkali metal or an ammonium group.

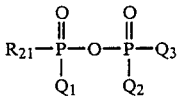

(VIII)

wherein $R_{21}$ represents an alkyl group having from 1 to 12 carbon atoms, an alkoxy group having from 1 to 12 carbon atoms, a monoalkylamino group having from 1 to 12 carbon atoms, a dialkylamino group having from 2 to 12 carbon atoms, an amino group, an aryloxy group having from 1 to 24 carbon atoms, an arylamino group having from 6 to 24 carbon atoms or an amyloxy group; and $Q_1$ to $Q_3$ each represents —OH, an alkoxy group having from 1 to 24 carbon atoms, an aralkyloxy group, an aryloxy group, —OM″ (wherein M″ represents a cation), an amino group, a morpholino group, a cyclic amino group, an alkylamino group, a dialkylamino group, an arylamino group or an alkyloxy group.

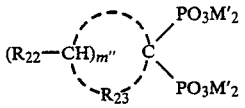

(IX)

wherein $R_{22}$ represents a hydrogen atom, a lower alkyl group or an imine residual group which can optionally be substituted by a lower alkyl group or $CH_2CH_2COONa$; $R_{23}$ represents a lower alkylene group;

M′ represents a hydrogen atom, an alkali metal or an ammonium group; and m″ represents an integer of from 2 to 16.

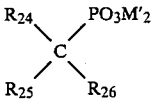

(X)

wherein $R_{24}$ to $R_{26}$ each represents a hydrogen atom or an alkyl group optionally substituted by —OH, $—OC_{n''}H_{2n''=1}$(wherein n″ is 1 to 4), $—PO_3M'_2$, $—CH_2PO_3M'$,

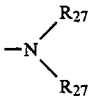

wherein $R_{27}$ represents an alkyl group and/or $—N(CH_2PO_3M'_2)_2$; and M′ represents a hydrogen atom, an alkali metal or an ammonium group.

Examples of compounds of formulae (II) to (X) are shown below.

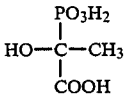

(1)

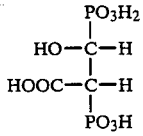

(2)

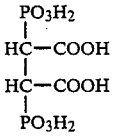

(3)

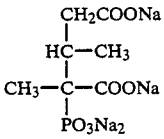

(4)

-continued

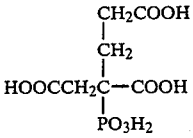

(5)

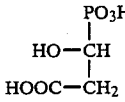

(6)

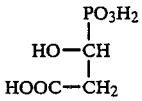

(7)

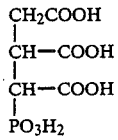

(8)

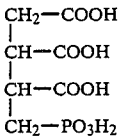

(9)

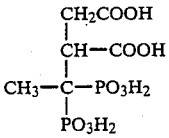

(10)

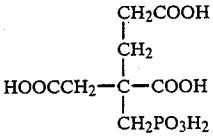

(11)

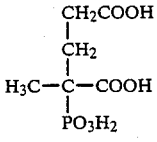

(12)

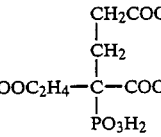

(13)

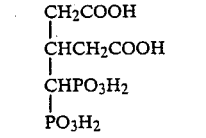

(14)

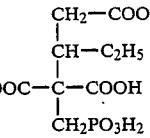

(15)

-continued
(16)
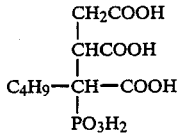
(17)
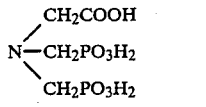
(18)
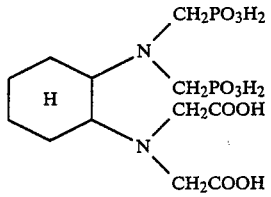
(19)
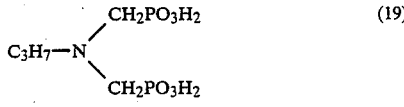
(20)
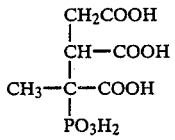
(21)
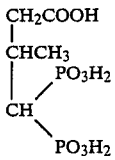
(22)
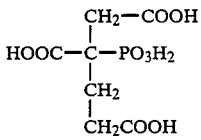
(23)
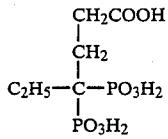
(24)
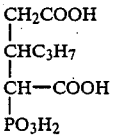
(25)
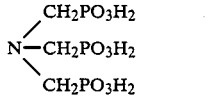
(26)
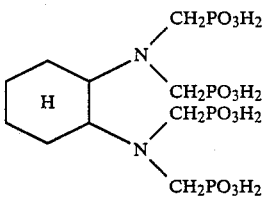
-continued
(27)
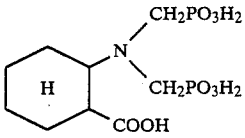
(28)
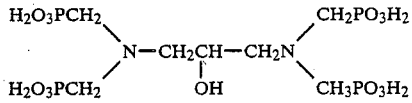
(29)
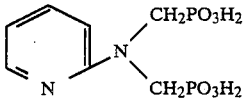
(30)
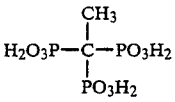
(31)
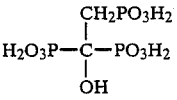
(32)
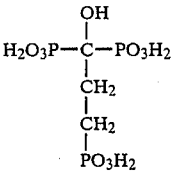
(33)
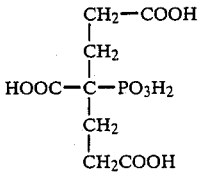
(34)
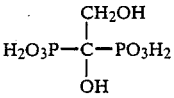
(35)
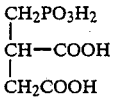
(36)
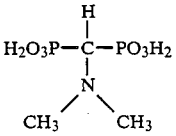
(37)
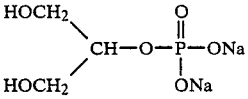
(38)
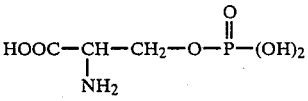

-continued
(39)
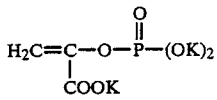
(40)
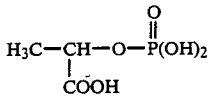
(41)
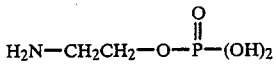
(42)
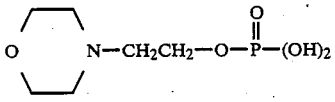
(43)
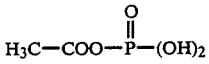
(44)
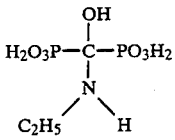
(45)
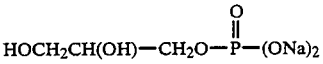
(46)
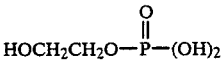
(47)
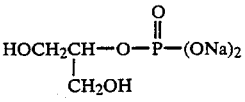
(48)
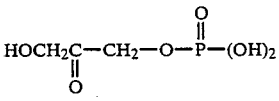
(49)
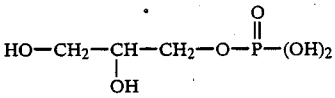
(50)
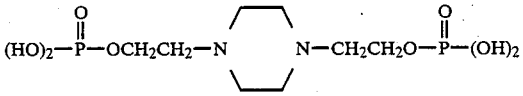
(51)
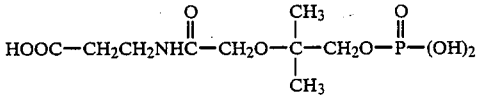
(52)
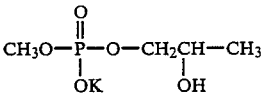
(53)
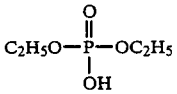
-continued
(54)
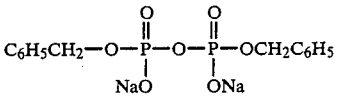
(55)
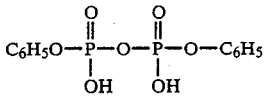
(56)
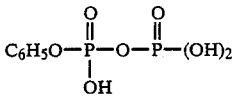
(57)
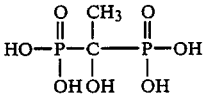
(58)
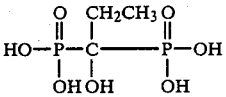
(59)
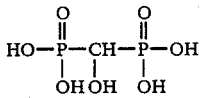
(60)
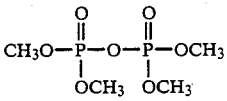
(61)
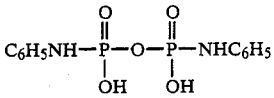
(62)
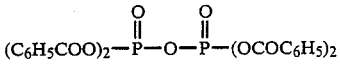
(63)
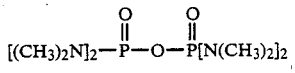
(64)
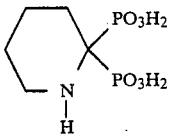
(65)
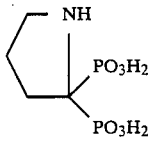
(66)
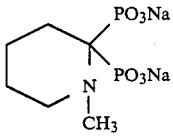
(67)
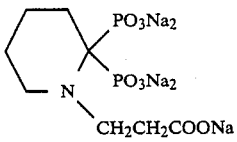

-continued

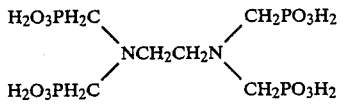

(68)

The amount of the organic phosphonic acid series chelating compound to be added is from 0.1 g to 40 g, preferably from 0.2 g to 10 g, per liter of the color developer. Among the above-mentioned compounds, those of formula (III) are most preferred.

The color developer to be used in the present invention contains a known aromatic primary amine color developing agent. Preferred examples of the developing agent are p-phenylenediamine derivatives.

Specific examples of the derivatives are shown below, which, however, are not limitative.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)ethyl]
D-7: N-(2-amino-5-diethylaminophenylethyl)methanesulfonamide
D-8: N,N-dimethyl-p-phenylenediamine
D-9: 4-Amino-3-methyl-N-ethyl-N-methoxyethylaninline
D-10: 4-Amino-3-methyl-N-ethyl-N-β-ethoxyethylaninline
D-11: 4-Amino-3-methyl-N-ethyl-N-β-butoxyethylaninline Among the above-mentioned p-phenylenediamine derivatives, 4-Amino-3-methyl-N-ethyl-N-[β-(methanesulfonamido)ethyl] aniline (Compound D-6) is most preferred.

These p-phenylenediamine derivatives may be in the form of their salts, such as sulfates, hydrochlorides, sulfites, p-toluenesulfonates, etc. The amount of the aromatic primary amine color developing agent to be added is from about 0.1 g to about 20 g, preferably from about 0.5 g to about 10 g, per liter of the color developer.

The color developer may optionally contain any desired development accelerator. However, it is preferred that the color developer of the present invention does not contain a substantial amount of benzyl alcohol from the viewpoint of prevention of environmental pollution, ease of preparation of the developer and prevention of fog. The phrase "does not contain a substantial amount of benzyl alcohol" means that the benzyl alcohol content is 2 ml or less per liter of the color developer. Most preferably, the color developer is quite free from benzyl alcohol.

The color developer may further contain, as other preservatives, sulfites such as sodium sulfite, potassium sulfite, sodium bisulfite, potassium bisulfite, sodium metasulfite, potassium metasulfite, etc. or carbonyl-sulfite adducts, if desired. The amount of sulfite preservative to be added to the color developer is from 0 to 20 g/liter or less, preferably from 0 to 5 g/liter or less, but is preferred to be an amount which is as small as possible, provided that the stability of the color developer can be maintained.

As compounds capable of directly preserving the above-mentioned color developing agents, various kinds of hydroxylamines, the hydroxamic acid described in Japanese patent application No. 186559/86, the hydrazines and hydrazides described in Japanese patent application No. 170756/86, the phenols described in Japanese patent application Nos. 188742/86 and 203253/86, the α-hydroxyketones or α-aminoketones described in Japanese patent application No. 188741/86 and/or other various kinds of saccharides described in Japanese patent application No. 180616/86 are preferable added. In addition, it is also preferred to use, together with the above-mentioned compounds, the monoamines described in Japanese patent application Nos. 147823/86, 166674/86, 165621/86, 164515/86, 170789/86, 168159/86, etc., the diamines described in Japanese patent application Nos. 173595/86, 164515/86, 186560/86, etc., the polyamines described in Japanese patent application Nos. 165621/86, 169789/86, etc., the polyamines described in Japanese patent application No. 188619/86, etc., the nitroxy radicals described in Japanese patent application No. 197760/86, etc., the alcohols described in Japanese patent application Nos. 186561/86, 197419/86, etc., the oximes described in Japanese patent application No. 198987/86, etc., and the tertiary amines described in Japanese patent application no. 265149/86, etc.

As other preservatives, various kinds of metals described in Japanese patent application (OPI) Nos. 44148/82 and 53749/82, the salicylic acids described in Japanese patent application (OPI) No. 180588/84, the alkanolamines described in Japanese patent application (OPI) No. 3532/79, the polyethyleneimines described in Japanese patent application (OPI) No. 94349/81, the aromatic polyhydroxy compounds described in U.S. Pat. No. 3,746,544, etc. can also be added to the color developer, if desired. In particular the addition of the aromatic polyhydroxy compounds, the alkanolamines, the compounds described in Japanese patent application No. 264159/86, etc. is preferred.

The color developer for use in the present invention preferably has a pH value of from 9 to 12, more preferably from 9 to 11.0, and can further contain any other known developer-constituting components.

In order to maintain the above-mentioned pH value range, various kinds of buffers can preferably be used. The buffers include carbonic acid salts, phosphoric acid salts, boric acid salts tetraboric acid salts, hydroxybenzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, lysine salts, etc. In particular, carbonic acid salts, phosphoric acid salts, tetraboric acid salts and hydroxybenzoic acid salts have excellent solubility, and have a buffer ability in the high pH range of 9.0 or more and, at the same time have other advantages, such as not having any deleterious effects on the photographic characteristics (such as fog, etc.) when added to a color developer and additionally being inexpensive. Accordingly, the use of these four kinds of buffers is especially preferred.

Specific examples of the especially preferred buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not restricted to the use of these particular compounds.

The amount of buffer to be added to the color developer is preferably 0.1 mol/liter or more, especially preferably from 0.1 mol/liter to 0.4 mol/liter.

In addition, the color developer may further contain other kinds of chelating agents together with the above-mentioned organic phosphonic acid series chelating agent.

Specific examples of the chelating agents which can be used together with the organic phosphonic acid series chelating agents are mentioned below, which, however, are not limitative upon the scope of the invention.

Such chelating agents include nitrilo-triacetic acid, diethylenetriamine-pentaacetic acid, ethylenediamine-tetraacetic acid, trans-cyclohexanediamine-tetraacetic acid, 1,2-diaminopropane-tetraacetic acid, glycoletherdiamine-tetraacetic acid, ethylenediamine-orthohydroxyphenylacetic acid, N,N'-bis(2hydroxybenzyl)ethylenediamine-N,N'-diacetic acid, etc.

These chelating agents can be used in the form of a combination of two or more of them, if desired.

The color developer may also contain any desired development accelerator, if desired. However, it is preferred that the color developer of the present invention does not contain a substantial amount of benzyl alcohol for the above-mentioned reasons.

As development accelerators, the thioether series compounds described in Japanese patent publication Nos. 16088/62, 5987/62, 7826/63, 12380/69 and 9019/70, U.S. Pat. No. 3,813,237, etc.; the p-phenylenediamine series compounds described in Japanese patent application (OPI) Nos. 49829/77 and 15554/75, etc.; the quaternary ammonium salts described in Japanese patent application (OPI) No. 137726/75, Japanese patent publication No. 30074/69, Japanese patent application (OPI) Nos. 156826/81 and 43429/77, etc.; the amine series compounds described in U.S. Pat. Nos. 2,494,903, 3,128,182, 4,230,796 and 3,253,919, Japanese patent publication No. 11431/66, U.S. Pat. Nos. 2,482,456, 2,596,929 and 3,582,346, etc.; the polyalkylene oxides described in Japanese patent publication Nos. 16088/62 and 25201/67, U.S. Pat. Nos. 3,128,183, Japanese patent publication Nos. 11431/66 and 23883/67, U.S. Pat. No. 3,532,501, etc.; and other 1-phenyl-3-pyrazolidones, imidazoles, etc. can be added, if desired.

In the practice of the present invention, any desired antifoggant can be added, if desired. As the antifoggant, alkali metal halides, such as sodium chloride, potassium bromide or potassium iodide and organic antifoggants can be used. Specific examples of organic antifoggants are nitrogen-containing heterocyclic compounds, for example, including benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolymethyl-benzimidazole, indazole, hydroxyazaindolidine, adenine, etc.

Further, various kinds of surfactants such as alkylsulfonic acids, arylphosphonic acids, aliphatic carboxylic acids aromatic carboxylic acids, etc. can also be added, if desired.

The processing temperature of the color developer of the present invention may range from 20° to 50° C., preferably from 30° to 40° C. The processing time may range from 20 seconds to 5 minutes, preferably from 30 seconds to 2 minutes. The amount of the replenisher used to replenish the color development bath is preferably small, such as from 20 to 600 ml, preferably from 50 to 300 ml, and more preferably from 100 to 200 ml, per $m^2$ of the photographic material being processed.

Next, the bleaching solution, the bleach-fixing solution and fixing solution for use in the present invention will be explained below.

Any and every bleaching agent can be used in the bleaching solution or bleach-fixing solution for use in the present invention, and in particular, organic iron(III) complex salts (for example, complex salts with aminopolycarboxylic acids, such as ethylenediamine-tetraacetic acid, diethylenetriamine-pentaacetic acid, etc., or with aminopolyphosphonic acids, phosphonocarboxylic acids or organic phosphonic acids) or organic acids, such as citric acid, tartaric acid, malic acid, etc.; persulfates; hydrogen peroxide, etc. are preferred as the bleaching agent.

The organic iron(III) complex salts are especially preferred from the viewpoint of rapid processability and the prevention of environmental pollution. Examples of aminopolycarboxylic acid, aminopolyphosphonic acid and organic phosphonic acids and their salts which are useful for the formation of organic iron(III) complex salts include ethylenediamine-tetraacetic acid, diethylenetriamine-pentaacetic acid, 1,3-diaminopropane-tetraacetic acid, propylenediamine-tetraacetic acid, nitrolio-triacetic acid, cyclohexanediamine-tetraacetic acid, methylimino-diacetic acid, iminodiacetic acid, glycoletherdiamine-tetraacetic acid, etc. These compounds may be in any form of sodium, potassium, lithium or ammonium salts. Among these compounds, iron(III) complex salts of ethylenediamine-tetraacetic acid, diethylenetriamine-pentaacetic acid, cyclohexanediamine-tetraacetic acid, 1,3-diaminopropane-tetraacetic acid or methyliminodiacetic acid are especially preferred, as these have a high bleaching capacity.

The ferric complex salts can be used in the form of a complex salt or, alternatively, a ferric salt, such as ferric sulfate, ferric chloride, ferric nitrate, ferric ammonium sulfate, ferric phosphate, etc. and a chelating agent, such as an aminopolycarboxylic acid, aminopolyphosphonic acid, phosphonocarboxylic acid, etc. can be added to a solution where the intended ferric complex salt is formed therein. In this case, the chelating agent can be used in an amount which exceeds the amount necessary for the formation of the ferric complex salt. Among the iron complexes, aminopolycarboxylic acid/iron complexes are preferred, and the amount thereof to be added may be from 0.01 to 1.0 mol/liter, preferably from 0.05 to 0.50 mol/liter.

Various kinds of compounds can be added to the bleaching solution or the bleach-fixing solution and/or the previous bath, as a bleaching accelerator. For example, the mercapto group- or disulfide bond-containing compounds described in U.S. Pat. No. 3,893,858, West German Pat. No. 1,290,812, Japanese patent application (OPI) No. 95630/78, *Research Disclosure,* No. 17129 (July, 1978), etc.; the thiourea series compounds described in Japanese patent publication No 8506/70, Japanese patent application (OPI) Nos. 20832/77 and 32735/78, U.S. Pat. No. 3,706,561, etc.; and halides such as iodides, bromides, etc. are preferred as having an excellent bleaching capacity.

In addition, the bleaching solution or the bleach-fixing solution can also contain a re-halogenating agent, for example, bromides (e.g., potassium bromide, sodium bromide, ammonium bromide), chlorides (e.g., potassium chloride, sodium chloride, ammonium chloride) or iodides (e.g., ammonium iodide), etc. If desired, the solution may further contain one or more organic acids and inorganic acids having a pH-buffering ability and alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., or a corrosion-inhibitor such as ammonium nitrate, guanidine, etc.

The fixing agent to be used in the bleach-fixing solution or fixing solution for use in the present invention may be a known fixing agent which is a water-soluble silver halide solvent, for example, including thiosulfates, such as sodium thiosulfate, ammonium thiosulfate, etc.; thiocyanates, such as sodium thiocyanate, ammonium thiocyanate, etc.; and thioether compounds and thiourea compounds, such as ethylenebisthioglycolic acid, 3,6-dithia-1,8-octanediol, etc. These can be used singly or in a mixture containing two or more of them.

In addition, a special bleach-fixing solution comprising the combination of a fixing agent and a large amount of a halide, such as potassium iodide, as described in Japanese patent application (OPI) No. 155354/80, can also be used in the present invention.

In the practice of the present invention, the use of thiosulfates, especially ammonium thiosulfates, is preferred.

The amount of the fixing agent in the bleach-fixing solution or fixing solution is preferably within the range of from 0.3 to 2 mols, more preferably from 0.5 to 1.0 mol, per liter of the solution. The pH range of the bleach-fixing solution or fixing solution is preferably within the range of from 3 to 10, particularly preferably from 5 to 9.

The bleach-fixing solution can additionally contain various other kinds of brightening agents, defoaming agents or surfactants, as well as organic solvents such as polyvinyl pyrrolidone, methanol, etc.

The bleach-fixing solution or fixing solution for use in the present invention contains, as a preservative, a sulfite ion-releasing compound, such as sulfites (e.g., sodium sulfite, potassium sulfite, ammonium sulfite, etc.), bisulfites (e.g., ammonium bisulfite, sodium bisulfite, potassium bisulfite, etc.), metabisulfites (e.g., potassium metabisulfite, sodium metabisulfite, ammonium metabisulfite, etc.), etc. These compounds can be incorporated into the bleach-fixing or fixing solution preferably in an amount of from 0.02 to 0.50 mol/liter, more preferably in an amount of from 0.04 to 0.40 mol/liter, as sulfite ion.

As the preservative, the addition of sulfites is conventional, but any other ascorbic acid, carbonyl-bisulfite adducts or carbonyl compounds or the like can also be added.

In addition, a buffer, a brightening agent, a chelating agent, a defoaming agent, a bactericide, etc. can further be added, if desired.

The processing time for the desilvering step in the method of the present invention is desirably shorter than that which is conventional, since the effect of the present invention is more remarkable with such shorter processing times. The desilvering time is preferably 2 minutes or less, and more preferably 1 minute or less.

The silver halide color photographic materials processed by the method of the present invention are generally subjected to rinsing with water and/or stabilization, after the desilvering step of fixation or bleach-fixation.

The amount of water used in the rinsing step can broadly be defined in accordance with the characteristics of the photographic material being processed (for example, on the basis of the constituting ingredients such as couplers, etc.), the use of the material, the temperature of the rinsing water, the number of the rinsing tanks (the number of rinsing stages), the replenishing system of countercurrent or normal current flow and various other conditions. Specifically, the relation between the number of the rinsing tanks in a multi-stage countercurrent system and the amount of rinsing water used in the system can be obtained by the method described in *Journal of the Society of Motion Picture and Television Engineers,* Vol. 64, pages 248–253 (May, 1955). In general, the number of stages in a multi-stage countercurrent system is preferably from 2 to 6, especially preferably from 2 to 4.

In accordance with the multi-stage countercurrent system, the amount of rinsing water used in the system can be noticeably reduced and, for example, the amount may be one liter or less, preferably 0.5 liter or less, per $m^2$ of the photographic material being processed and, therefore, the effect of the present invention is remarkable. However, one problem in such a system is that bacteria would propagate in the tanks, because of the protracted residence time of the rinsing water therein, so that the floating bacteria formed would adhere to the photographic material being processed.

To overcome this problem, in accordance with the method of the present invention for processing the color photographic material, the method of reducing calcium and magnesium, which is described in Japanese patent application No. 131632/86, can be extremely effective. In addition, the isothiazolone compounds and thiabendazoles described in Japanese patent application (OPI) No. 8542/82; the chlorine series bactericides such as chlorinated sodium isocyanurates, etc. described in Japanese patent application (OPI) No. 120145/86; the benzotraizoles described in Japanese patent application (OPI) No. 267761/86; copper ion and other bactericides described in H. Horiguchi, *Chemistry of Bactericidal and Fungicidal Agents, Bactericidal and Fungicidal Techniques for Microorganisms* (by Sanitary Technical Association, Japan), and *Encyclopedia of Bactericidal and Fungicidal Agents* (by Japan Bactericidal and Fungicidal Society), etc. can also be used.

In addition, a surfactant as a water-flushing agent, as well as a chelating agent such as EDTA as a hard water softener, can be added to the rinsing water.

Following the above-mentioned rinsing step, the material is processed with a stabilizing solution, or alternatively, it can be directly processed with a stabilizing solution in place of the rinsing step.

Compounds having an image stabilizing function can be added to the stabilizing solution, and include aldehyde compounds, such as formalin, buffers for adjusting the film pH suited for image stabilization and ammonium compounds. In addition, the above-mentioned various kinds of bactericides and fungicides can also be added to prevent the propagation of bacteria in the solution or to impart a antifungal property to the photographic material after it has been processed.

Further, a surfactant, a brightening agent and a hardener can also be added to the stabilizing solution. In the processing of the photographic material according to the present invention, if the stabilization step is directly carried out in place of the rinsing step, any and every known method, for example as described in Japanese patent application (OPI) Nos. 8543/82, 14834/83, 184343/84, 220345/85, 238832/85, 239784/85, 239749/85, 4054/86, 118749/86, etc., can be used.

In addition, a chelating agent, such as 1-hydroxyethylidene-1,1-diphosphonic acid, ethylenediamine-tetramethylenephosphonic acid, etc., as well as a magnesium compound and a bismuth compound, can also be used as a preferred embodiment of the present invention.

Like the rinsing water, the amount of the stabilizing solution can also be reduced remarkably (for example, to one liter or less, more preferably 0.5 liter or less), by using a multi-stage countercurrent system. The replenishment of the rinsing water or the stabilizing solution can be effected either continuously or intermittently. In the latter case, the replenishment is effected in accordance with the amount of photographic material to be processed or at regular intervals.

In the practice of the present invention, the pH value of the rinsing water or the stabilizing solution is from 4 to 10, and preferably from 5 to 8. The temperature can variously be defined in accordance with the use, characteristics, etc., of the photographic material being processed, but is generally from 15° to 45° C., and preferably from 20° to 40° C. The time can be defined freely, but a shorter time is preferred as the effect of the present invention is more remarkable. Preferably, the time is from 30 seconds to 2 minutes, and more preferably from 30 seconds to 1 minute and 30 seconds. The amount of the replenisher is better to be small from the viewpoints of the low running cost, the reduced drainage, the easy operation, etc. In addition, the effect of the present invention is more remarkable when the amount of the replenisher added during processing is small.

More specifically, the amount of replenisher may be from 0.5 to 50 times, preferably from 3 to 40 times, of the amount of the processing solution brought into the tank from the previous tank, per unit area of the photographic material being processed.

The solution used in the rinsing and/or stabilization steps can be used further in the previous steps. As an example of this case, the overflow of the rinsing water as reduced by the multi-stage countercurrent system is returned back to the previous bleach-fixing bath and a concentrated solution is replenished to the bleach-fixing bath, so that the amount of the drainage from the process can be reduced.

In the practice of the present invention, the total time of the bleach-fixing step and the rinsing or stabilization step is preferred to be 3 minutes or less.

The method of the present invention can be applied to any and every photographic processing procedure which uses a color developer. For example, the method can suitably be applied to the photographic processing of color papers, color reversal papers, color direct positive photographic materials, color positive films, color negative films, color reversal films, etc., and in particular, this method is especially suitably applied to color papers and color reversal papers which are highly sensitive to staining of the papers.

The silver halide emulsions of the photographic materials to be processed by the present invention may have any halogen composition, for example, silver iodobromide, silver bromide, silver chlorobromide, silver chloride, etc. However, when the materials are processed by rapid processing or use reduced amounts of replenishers, the emulsion is preferably a silver chlorobromide emulsion containing 80 mol % or more silver chloride or silver chloride emulsion and is especially preferably a silver chlorobromide emulsion containing from 90 to 100 mol % silver chloride. The effect of the present invention is especially remarkable when the photographic material having the above-mentioned emulsion is processed by rapid processing or uses reduced amounts of replenishers.

The silver halide grains for use in the present invention may differ in composition or phase between the inside and the surface layer thereof, may have a multiphase structure having a junction structure, or may have a uniform phase or composition throughout the whole grain. Also the silver halide grains may be composed of a mixture of these grains having different phase structures.

The mean grain size (the diameter of the grain when the grain is spherical or resembles spherical, the mean value based on the projected area using the edge length as the grain size when the grain is a cubic grain, or the diameter of the corresponding circle when the grain is a tabular grain) of the silver halide grains for use in the present invention is preferably from 0.1 μm to 2 μm, and more preferably from 0.15 μm to 1.5 μm. The grain size distribution of the silver halide emulsion for use in the present invention may be narrow or broad, but a so-called monodispersed silver halide emulsion, wherein the value (variation coefficient) obtained by dividing the standard deviation in the grain distribution curve by the mean grain size is within about 20%, and more preferably within 15%, is preferably used in the present invention. Also, for satisfying the gradation required for a color photographic material, two or more kinds of monodispersed silver halide emulsions (preferably having the above-described variation coefficient as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in the present invention may have a regular crystal form such as cubic, octahedral, rhombic dodecahedral, tetradecahedral, etc., may be a mixture comprising the regular crystal forms, may have an irregular crystal form, such as spherical, or, further, may have a composite form of these crystal forms. Also, a tabular grain silver halide emulsion can be used in the present invention. In particular, a tabular grain silver halide emulsion wherein tabular silver halide grains having an aspect ratio (length/thickness ratio) of from 5 to 8 or 8 or more account for 50% or more of the total projected area of the silver halide grains may be used. The silver halide emulsion for use in the present invention may be a mixture of these emulsions containing silver halide grains each having different crystal forms. Also, the silver halide grains may be of a surface latent image type capable of forming latent images mainly on the surfaces thereof or of an internal latent image type capable of forming latent images mainly in the inside thereof.

The photographic emulsions for use in the present invention can be prepared by the method described in *Research Disclosure* (RD); Vol. 170, Item No. 17643, I, II and III (December, 1978).

The emulsions for use in the present invention are generally physically ripened, chemically ripened or spectrally sensitized. The additives to be used for the ripening or sensitizing steps are described in *Research Disclosure* (RD), Vol. 176, Item No. 17643 (December, 1978) and ibid., Vol. 187, Item No. 18716 (November, 1979), and the relevant parts in these publications are summarized in the following Table.

Known photographic additives which can be used in the present invention are also described in these two *Research Disclosure* publications and these are also described in the same Table below.

| Additives | RD 17643 | RD 18716 |
|---|---|---|
| 1. Chemical Sensitizer | p. 23 | p. 648, right column |
| 2. Sensitivity Enhancer | | p. 648, right column |
| 3. Spectral Sensitizer | pp. 23–24 | from p. 648, right column to p. 649, right column |
| 4. Supersensitizing Agent | 23–24 | from p. 648, right column to p. 649, right column |
| 5. Brightening Agent | p. 24 | |
| 6. Antifoggant, and Stabilizer | pp. 24–25 | p.649, right column |
| 7. Coupler | p. 25 | |
| 8. Organic Solvent | p. 25 | |
| 9. Light Absorber, and Filter Dye | pp. 25–26 | from p. 649, right column to p. 650, left column |
| 10. UV Absorbent | pp. 25–26 | from p. 649, right column to p. 650, left column |
| 11. Stain Inhibitor | p. 25, right right column | p. 650, from left to right column |
| 12. Color Image Stabilizer | p. 25 | |
| 13. Hardener | p. 26 | p. 651, left column |
| 14. Binder | p. 26 | p. 651, left column |
| 15. Plasticizer and Lubricant | p. 27 | p. 650, right column |
| 16. Coating Aid and Surfactant | pp. 26–27 | p. 650, right column |
| 17. Antistatic Agent | p. 27 | p. 650, right column |

Various kinds of color couplers can be used in the present invention. The color couplers means compounds which can form a dye by a coupling reaction with the oxidation product of an aromatic primary amine developing agent. Specific examples of useful color couplers include naphthol or phenol series compounds, pyrazolone or pyrazoloazole series compounds and open chain or heterocyclic ketomethylene compounds. Concrete compounds of these cyan, magenta and yellow couplers which can be used in the present invention are described in patent publications referred to in *Research Disclosure* (RD), No 17643 (December, 1978), VII-D, and ibid., No. 18717 (November, 1979).

It is preferred that the couplers contained in the color photographic materials which are processed by the process of the present invention are nondiffusible due to having a ballast group or due to being polymerized. The use of 2-equivalent color couplers substituted by a releasable group can reduce the amount of silver needed to make the color photographic materials as compared to 4-equivalent color couplers having a hydrogen atom at the coupling active group. Couplers which release colored dyes having a proper diffusibility, non-color-forming couplers, DIR couplers releasing a development inhibitor with coupling reaction, or DAR couplers releasing a development accelerator with coupling reaction can also be used in the present invention.

As the yellow couplers for use in the present invention, oil protect type acylacetamido couplers are typical examples. Specific examples of these couplers are described in U.S. Pat. Nos. 2,407,210, 2,875,057, 3,265,506, etc. In the present invention, 2-equivalent yellow couplers are preferably used and specific examples of these yellows couplers are the oxygen atom-releasing type yellow couplers described in U.S. Pat. Nos. 3,408,194, 3,447,928, 3,933,501, 4,022,620, etc., and the nitrogen atom-releasing type yellow couplers described in Japanese Patent Publication No. 10739/80, U.S. Pat. Nos. 4,401,752, and 4,326,024, *Research Disclosure*, No. 18053 (April, 1979), British Pat. No. 1,425,020, West German patent application (OLS) Nos. 2,219,917, 2,261,361, 2,329,587, and 2,433,812, etc. In these yellow couplers, α-pivaloylacetanilide couplers provide excellent fastness, particularly with regard to the light fastness of colored dyes formed, while α-benzoylacetanilide couplers achieve excellent color density.

The magenta couplers which can be used in the present invention include oil protect type indazolone series or cynoacetyl series magenta couplers, and preferably 5-pyrazolone series magenta couplers and other pyrazoloazole series magenta couplers such as pyrazoloazoles. At the 5-pyrazolone series magenta couplers, those substituted by an arylamino group or an acylamino group at the 3-position thereof are preferred from the viewpoint of the hue and the color density of the colored dyes formed. Specific examples of these couplers are described in U.S. Pat. Nos. 2,311,082, 2,343,703, 2,600,788, 2,908,573, 3,062,653, 2,152,896, 3,936,015, etc. Also, as the releasable groups for the 2-equivalent 5-pyrazolone series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 provide a high color density.

As the pyrazoloazole series couplers, there are the pyrazolobenzimidazoles described in U.S. Pat. No. 3,369,879, and preferably the pyrazolo[5,1-c][1,2,4]triazoles described in U.S. Pat. No. 3,725,067, the pyrazolotetrazoles described in *Research Disclosure*, No. 24220 (June, 1984) and the pyrazolopyrazoles described in *Research Disclosure*, No. 24230 (June, 1984). The imidazo[1,2-b]pyrazoles described in European Pat. No. 119,741 are preferred as the colored dyes formed therefrom have a small degree of yellow side-absorption and have a high degree of light-fastness and, in particular, the pyrazolo[1,5-b][1,2,4]triazoles described in European Pat. No. 119, 860 are especially preferred.

As the cyan couplers for use in the present invention, there are oil protect type naphthol series or phenol series couplers. Specific examples of the cyan couplers include the naphthol series couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,895,826, etc. Cyan couplers having high fastness to humidity and temperature are preferably used in the present invention and typical examples of these cyan couplers include the phenol series cyan couplers having an alkyl group of 2 or more carbon atoms at the meta-position of the phenol nucleus described in U.S. Pat. No. 3,772,002; the 2,5-diacylamino-substituted phenol series cyan couplers described in U.S. Pat. Nos. 2,772,162, 3,758,308, 4,126,396, 4,334,011, and 4,327,173, West German Patent Application (OLS) No. 3,329,729, Japanese Patent Application (OPI) No. 166956/84, etc.; and the phenol series couplers having a phenylureido group at the 2-position thereof and an acylamino group at the 5-position thereof described in U.S. Pat. Nos. 3,446,622, 4,333,999, 4,451,559, 4,427,767, etc.

In particular, when at least one cyan coupler represented by the following formula (XI) is used in the photographic material processed by the present invention, an excellent photographic characteristics with little fog can be attained. Such an effect is surprising and is to be specifically noted.

Formula (XI) is represented as follows, which will be explained in detail hereinafter.

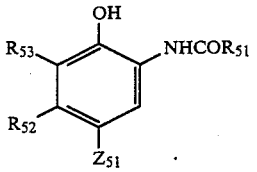

(XI)

wherein $R_{51}$ represents an alkyl group, a cycloalkyl group, an alkenyl group, an aryl group, a substituted or unsubstituted amino group or a heterocyclic group;

$R_{52}$ represents an acylamino group or an alkyl group having 2 or more carbon atoms;

$R_{53}$ represents a hydrogen atom, a halogen atom, an alkyl group or an alkoxy group;

$R_{53}$ may be bonded to $R_{52}$ to form a ring;

$Z_{51}$ represents a hydrogen atom, a halogen atom or a group capable of being released by a reaction with the oxidation product of an aromatic primary amine color developing agent (i.e., a coupling-off group).

In formula (XI), the alkyl, cycloalkyl or alkenyl group for $R_{51}$ is preferably an alkyl, cycloalkyl or alkenyl group having from 1 to 32 carbon atoms, including, for example, a methyl group, a butyl group, a tridecyl group, a cyclohexyl group, an allyl group, etc. The aryl group for $R_{51}$ includes, for example, a phenyl group, a naphthyl group, etc.; and the heterocyclic group may have nitrogen, oxygen and sulfur atoms as ring members and includes, for example, a 2-pyridyl group, a 2-furyl group, etc.

When $R_{51}$ is an amino group, it preferably is a phenyl-substituted amino group which may optionally have substituent(s).

$R_{51}$ may further be substituted by substituent(s) selected from a substituted or unsubstituted alkyl group, a substituted or unsubstituted aryl group, a substituted or unsubstituted alkyl- or aryl-oxy group (e.g., a methoxy group, a dodecyloxy group, an ethoxy group, a phenyloxy group, a 2,4-di-tert-amylphenoxy group, a 3-tert-butyl-4-hydroxyphenyloxy group, a naphthyloxy group, etc.), a carboxy group, a substituted or unsubstituted alkyl- or arylcarbonyl group (e.g., an acetyl group, a tetradecanoyl group, a benzoyl group, etc.), a substituted or unsubstituted alkyl- or aryl-oxycarbonyl group (e.g., a methoxycarbonyl group, a phenoxycarbonyl group, etc.), a substituted or unsubstituted acyloxy group (e.g., an acetyl group, a benzoyloxy group, etc.), a substituted or unsubstituted sulfamoyl group (e.g., an N-ethylsulfamoyl group, an N-octadecylsulfamoyl group, etc.), a substituted or unsubstituted carbamoyl group (e.g., an N-ethylcarbamoyl group, an N-methyldodecylcarbamoyl group, etc.), a substituted or unsubstituted sulfonamido group (e.g., a methanesulfonamido group, a benzenesulfonamido group, etc.), a substituted or unsubstituted acylamino group (e.g., an acetylamino group, a benzamido group, an ethoxycarbonylamino group, a phenylaminocarbonylamino group, etc.), a substituted or unsubstituted imido group (e.g., a succinimido group, a hydantoinyl group, etc.), a substituted or unsubstituted sulfonyl group (e.g., a methanesulfonyl group, etc.), a hydroxyl group, a cyano group, a nitro group and a halogen atom.

In formula (XI), $Z_{51}$ represents a hydrogen atom or a coupling-off group, and examples thereof include a halogen atom (e.g., a fluorine atom, a chlorine atom, a bromine atom, etc.), a substituted or unsubstituted alkoxy group (e.g., a dodecyloxy group, a methoxycarbamoylmethoxy group, carboxypropyloxy group, methylsulfonylethoxy group, etc.), a substituted or unsubstituted aryloxy group (e.g., a 4-chlorophenoxy group, a 4-methoxyphenoxy group, etc.), a substituted or unsubstituted acyloxy group (e.g., an acetoxy group, a tetradecanoyloxy group, a benzoyloxy group, etc.), a substituted or unsubstituted sulfonyloxy group (e.g., a methanesulfonyloxy group, a toluenesulfonyloxy group, etc.), a substituted or unsubstituted amido group (e.g., a dichloroacetylamino group, a methanesulfonylamino group, a toluenesulfonylamino group, etc.), a substituted or unsubstituted alkoxycarbonyloxy group (e.g., an ethoxycarbonyloxy group, a benzyloxycarbonyloxy group, etc.), a substituted or unsubstituted aryloxycarbonyloxy group (e.g., a phenoxycarbonyloxy group, etc.), a substituted or unsubstituted aliphatic or aromatic thio group (e.g., a phenylthio group, a tetrazolylthio group, etc.), a substituted or unsubstituted imido group (e.g., a succinimido group, a hydantoinyl group, etc.), a substituted or unsubstituted N-heterocyclic group (e.g., a 1-pyrazolyl group, a 1-benztriazolyl group, etc.), a substituted or unsubstituted aromatic azo group (e.g., a phenylazo group, etc.), etc. These coupling-off groups can contain a photographically useful group.

Formula (XI) may be in the form of a dimer or a higher polymer at the $R_{51}$ or $R_{52}$ position.

Concrete examples of the cyan couplers having the above-mentioned formula (XI) are shown below, which, however, are not intended to limit the scope of the present invention.

(C-1)
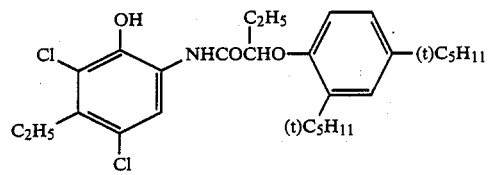
(C-2)
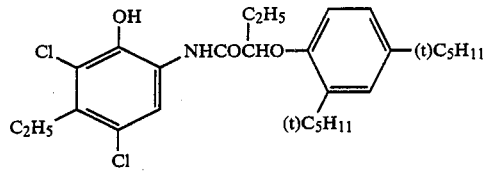
(C-3)
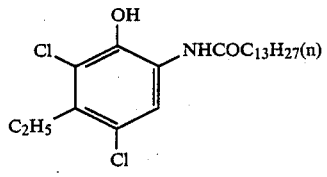
(C-4)
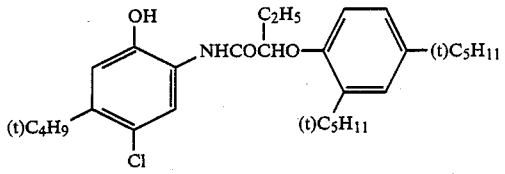
(C-5)
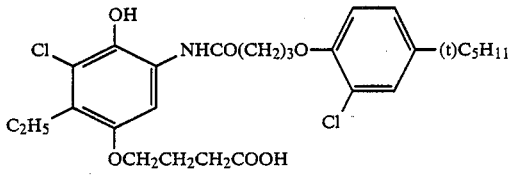
(C-6)
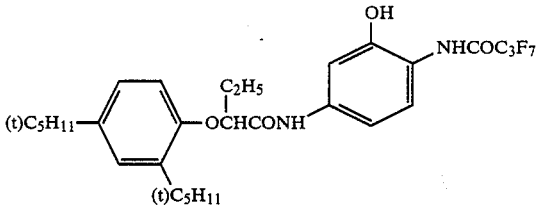
(C-7)
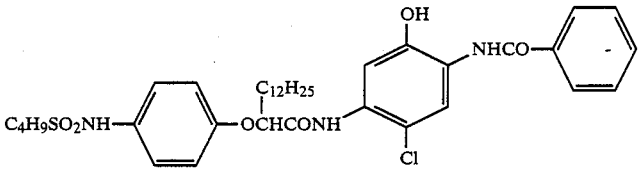
(C-8)
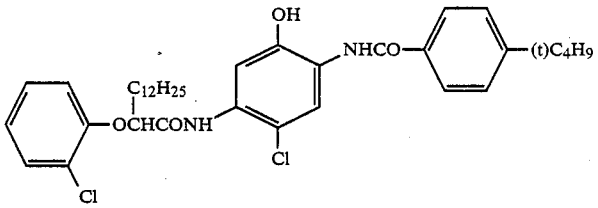

-continued
(C-9)
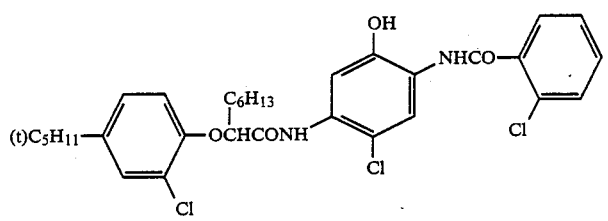
(C-10)
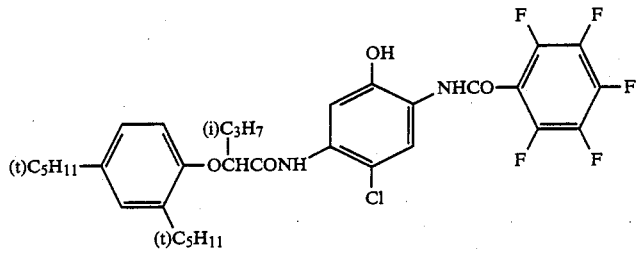
(C-11)
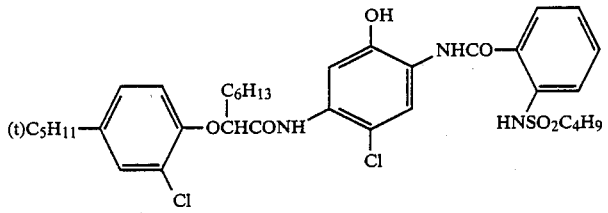
(C-12)
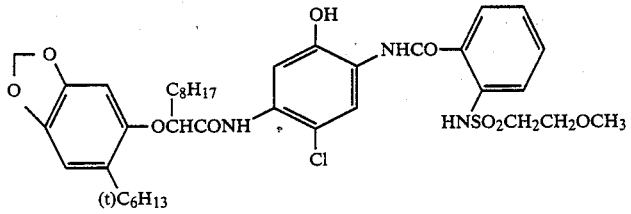
(C-13)
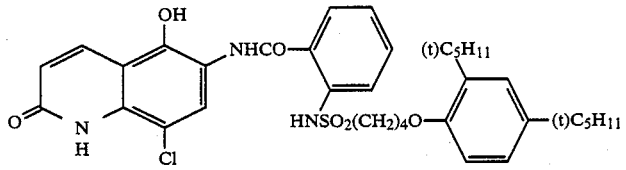
(C-14)
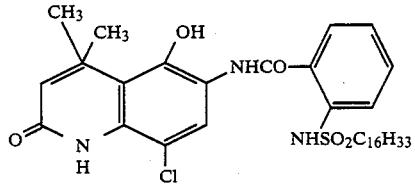
(C-15)
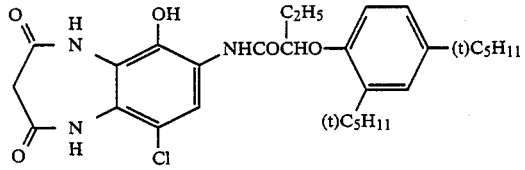

-continued
(C-16)
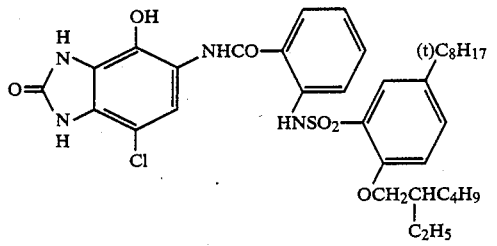
(C-17)
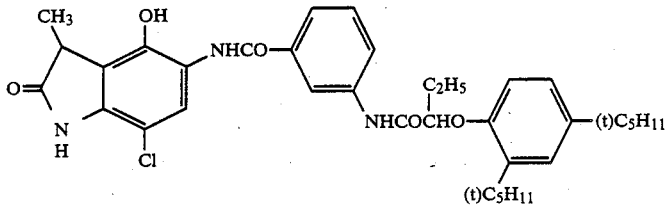
(C-18)
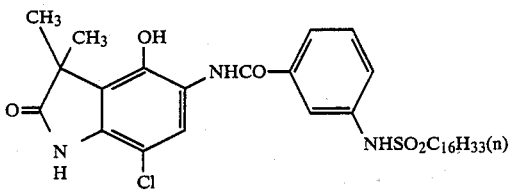
(C-19)
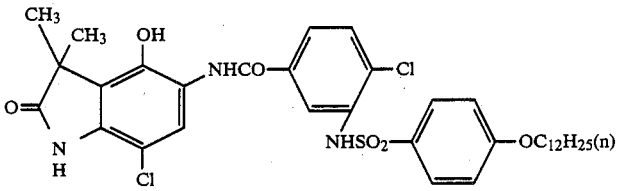
(C-20)
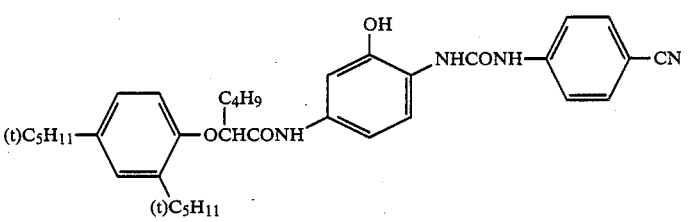
(C-21)
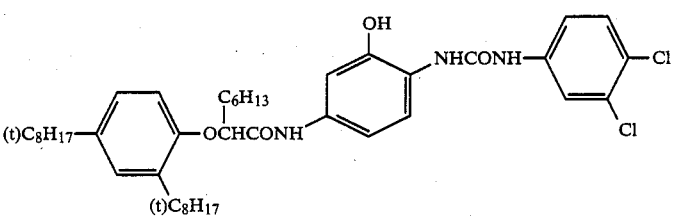
(C-22)
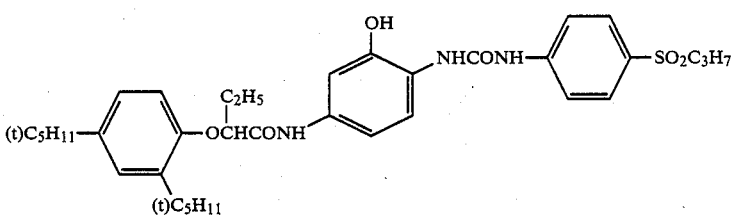

-continued (C-23)

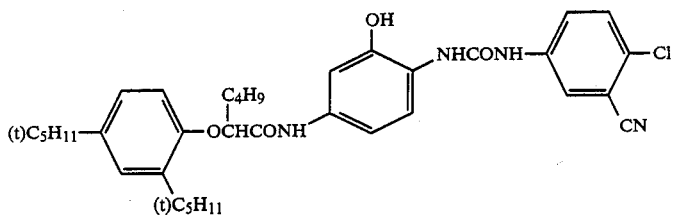

(C-24)

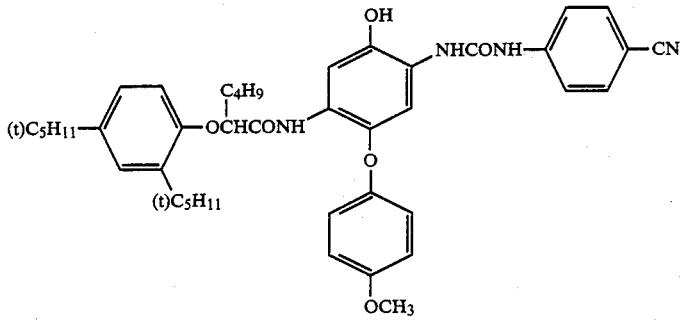

(C-25)

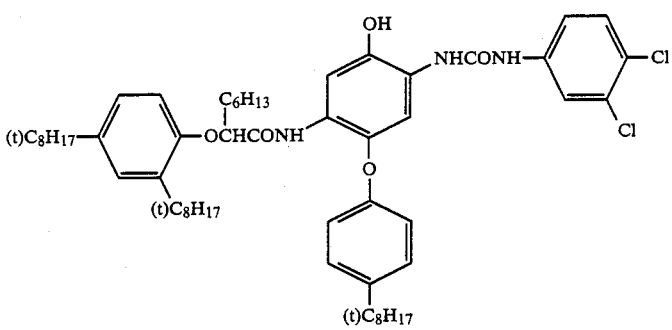

(C-26)

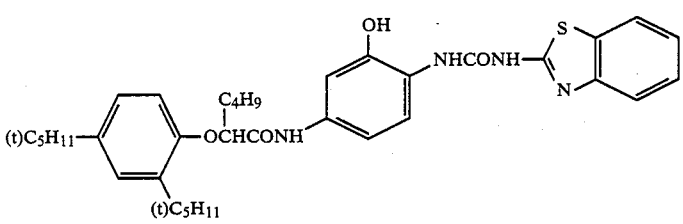

The cyan couplers of the above-mentioned formula (XI) can be produced on the basis of the disclosures of Japanese Patent Application (OPI) No. 166956/84 and Japanese Patent Application No. 11572/74.

In the present invention, by using couplers which release colored dyes having proper diffusibility together with the aforesaid color couplers, the graininess of color images formed can be improved. Specific examples of the magenta couplers releasing such diffusible dyes are described in U.S. Pat. No. 4,366,237 and British Pat. No. 2,125,570 and specific examples of yellow, magenta and cyan couplers of this type are described in European Pat. No. 96,570 and West German Patent Application (OLS) No. 3,234,533.

The dye-forming couplers and the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same light-sensitive layer of a color photographic material as a combination of two or more kinds thereof to obtain the particular characteristics desired for a color photographic material, or the same kind of coupler may be used for two or more light-sensitive layers to obtain the desired characteristics.

The couplers for use in the present invention can be introduced into the photographic materials by various known dispersion methods. Examples of high boiling point organic solvents for use in the oil-in-water dispersion method are described in U.S. Pat. No. 2,322,027, etc. Specific examples of the procedure, the effects, and the latexes for the latex dispersion method are described in U.S. Pat. No. 4,199,363, West German Patent Application (OLS) Nos. 2,541,274 and 2,541,230, etc.

The standard amount of the color coupler is in the range of from 0.001 to 1 mol per mol of the light-sensitive silver halide of a silver halide emulsion and the preferred amount is from 0.01 to 0.5 mol for yellow coupler, from 0.003 to 0.3 mol for magenta coupler, and from 0.002 to 0.3 mol for cyan coupler.

The photographic material for use in the present invention is coated on a conventional flexible support, such as plastic films (e.g., cellulose nitrate, cellulose acetate, polyethylene terephthalate, etc.), paper, etc., or a conventional stiff support, such as glass, etc. The supports and the coating method are described in detail in *Research Disclosure*, Vol, 176, Item No. 17643, XV (page 27) and XVII (page 28) (December, 1978).

In the present invention, reflective supports are preferably used. The "reflective support" is a support which can enhance reflectiveness, so that the color image formed in the silver halide emulsion layer is made sharper. Such reflective supports include a support coated with a hydrophobic resin having dispersed therein a light-reflective material such as titanium oxide, zinc oxide, calcium carbonate, calcium sulfate, etc., and a support composed of a hydrophobic resin having dispersed therein a light-reflective material as described above.

The following examples are intended to illustrate the present invention but not to limit it in any way.

EXAMPLE 1

A multilayer color photographic paper was prepared by forming the layers having the compositions shown below on a paper support both surfaces of which were coated with polyethylene. The coating compositions for the layers were prepared as follows.

Coating Composition for the First Layer (lowermost layer):

To a mixture of 19.1 g of Yellow Coupler (a) and 4.4 g of Color Image Stabilizer (b) were added 27.2 ml of ethyl acetate and 7.7 ml of Solvent (c) and dissolved therein, and the solution thus obtained was dispersed by emulsification in 185 ml of an aqueous 10 wt % gelatin solution containing 8 ml of a 10 wt % sodium dodecylbenzenesulfonate solution.

On the other hand, a silver chlorobromide emulsion (containing 1.0 mol % silver bromide and 70 g/kg of silver) containing the blue-sensitive sensitizing dye shown below in an amount of $5.0\times10^{-4}$ mol per mol of silver was prepared. The emulsified dispersion prepared above was mixed with the aforesaid silver halide emulsion and dissolved, and the coating solution for the first layer, having the composition as shown below, was prepared. Coating compositions for the second layer to the seventh layer (uppermost layer) were also prepared in the same manner as the first layer. As a gelatin hardening agent for each layer, 1-hydroxy-3,5-dichloro-s-triazine sodium salt was used.

The following spectral sensitizing dyes were used for the respective layers.

Blue-sensitive Emulsion Layer:

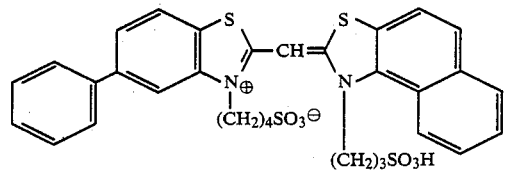

($5.0\times10^{-4}$ mol per mol of silver halide)

Green-sensitive Emulsion Layer:

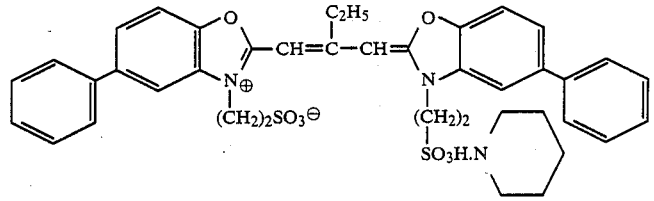

($4.0\times10^{-4}$ mol per mol of silver halide) and

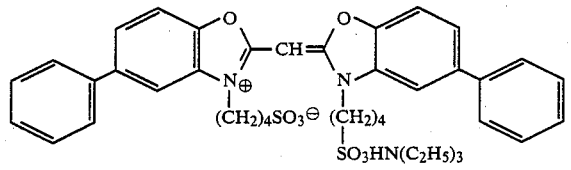

($7.0\times10^{-5}$ mol per mol of silver halide)

Red-sensitive Emulsion Layer

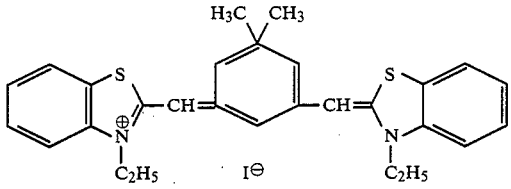

($0.9\times10^{-4}$ mol per ml of silver halide)

For the red-sensitive emulsion layer, the following compound was added in an amount of $2.6\times10^{-3}$ mol per mol of silver halide.

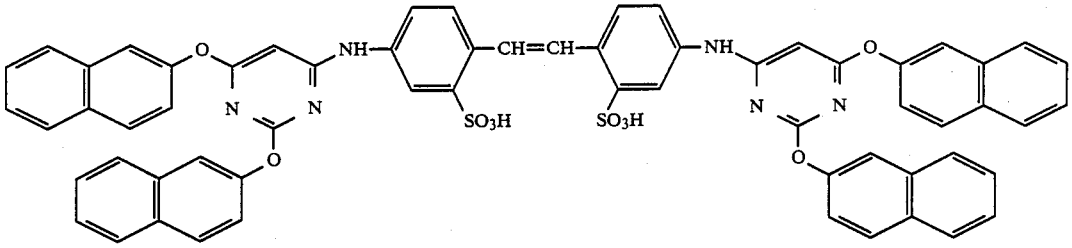

For the blue-sensitive emulsion layer, the green-sensitive emulsion layer and the red-sensitive emulsion layer, 1-(5-methylureidophenyl)-5-mercaptotetrazole was added each in an amount of $8.5\times10^{-5}$ mol, $7.7\times10^{-4}$ mol and $7.5\times10^{-4}$ mol, respectively, per mol of silver halide.

The following dyes were added to the emulsion layer for prevention of irradiation.

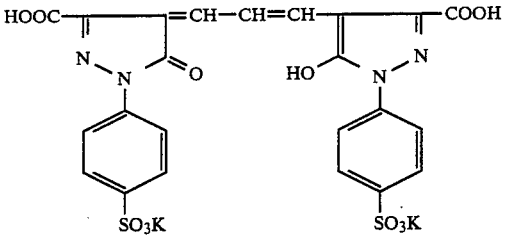

and

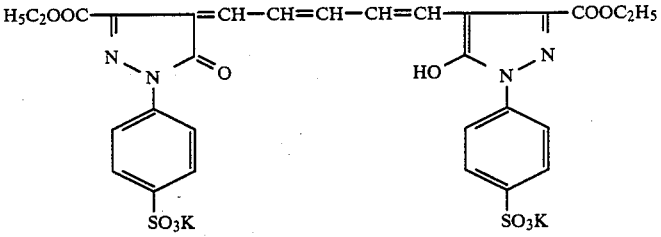

The compositions of the layers were as follows. In addition, the polyethylene coated paper as a support contained titanium dioxide as a white pigment and ultramarine as a bluish dye in the side having the first layer.

| | |
|---|---|
| First Layer: Blue-sensitive Emulsion Layer | |
| Silver Chlorobromide Emulsion (silver bromide 1.0 mol %) | 0.30 g/m$^2$ as Ag |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.35 g/m$^2$ |
| Second Layer: Color Stain Preventing Layer | |
| Gelatin | 0.99 g/m$^2$ |
| Color Stain Preventing Agent (d) | 0.08 g/m$^2$ |
| Third Layer: Green-sensitive Emulsion Layer | |
| Silver Chlorobromide Emulsion (silver bromide 0.5 mol %) | 0.36 g/m$^2$ as Ag |
| Gelatin | 1.24 g/m$^2$ |

-continued

| | |
|---|---|
| Magenta Coupler (e) | 0.31 g/m$^2$ |
| Color Image Stabilizer (f) | 0.25 g/m$^2$ |
| Color Image Stabilizer (g) | 0.12 g/m$^2$ |
| Solvent (h) | 0.42 g/m$^2$ |
| Fourth Layer: Ultraviolet Absorbing Layer | |
| Gelatin | 1.58 g/m$^2$ |
| Ultraviolet Absorbent (i) | 0.62 g/m$^2$ |
| Color Stain Preventing Agent (j) | 0.05 g/m$^2$ |
| Solvent (k) | 0.24 g/m$^2$ |
| Fifth Layer: Red-sensitive Emulsion Layer | |
| Silver Chlorobromide Emulsion (silver bromide 1 mol %) | 0.23 g/m$^2$ as Ag |
| Gelatin | 1.34 g/m$^2$ |
| Cyan Coupler (1) | 0.34 g/m$^2$ |
| Color Image Stabilizer (m) | 0.17 g/m$^2$ |
| Polymer (n) | 0.40 g/m$^2$ |
| Solvent (o) | 0.23 g/m$^2$ |
| Sixth Layer: Ultraviolet Absorbing Layer | |
| Gelatin | 0.53 g/m$^2$ |
| Ultraviolet Absorbent (i) | 0.21 g/m$^2$ |
| Solvent (k) | 0.08 g/m$^2$ |
| Seventh Layer: Protective Layer | |
| Gelatin | 1.33 g/m$^2$ |
| Acryl-modified Copolymer of Polyvinyl Alcohol (modification degree of 17%) | 0.17 g/m$^2$ |
| Liquid Paraffin | 0.03 g/m$^2$ |

The couplers and other compounds used in the Example 1 have the following structural formulae.

Yellow Coupler (a):
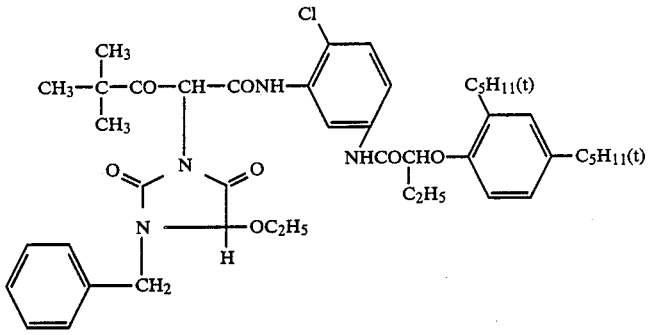
Color Image Stabilizer (b):
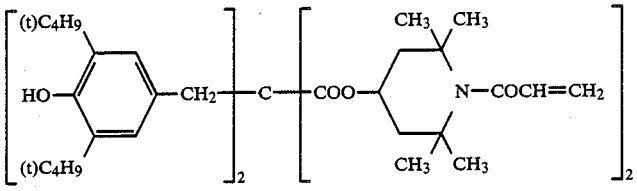
Solvent (c):
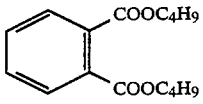
Color Stain Preventing Agent (d):
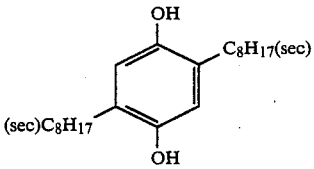
Magenta Coupler (e):
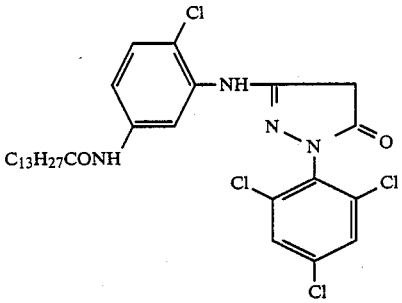
Color Image Stabilizer (f):
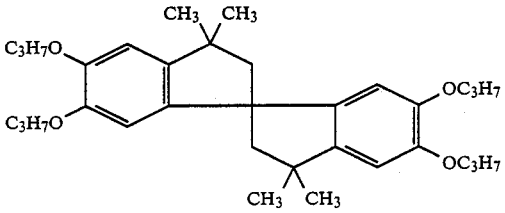
Color Image Stabilizer (g):
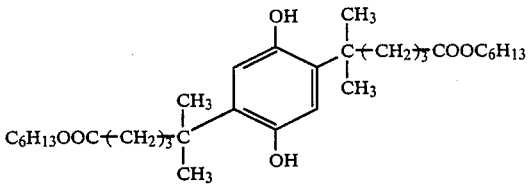

-continued
2/1 (by weight) mixture of the following compounds
Solvent (h):
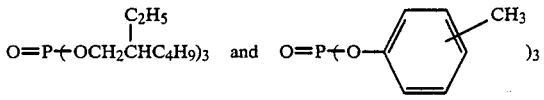
2/9/8 (by weight) mixture of the following compounds
UV Absorbent (i):
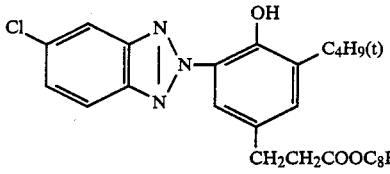
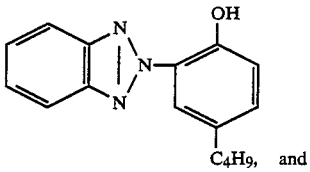
Color Stain Preventing Agent (j):
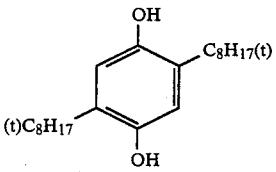
Solvent (k):
1/1 (by molar ratio) mixture of the following compounds
Cyan Coupler (l):
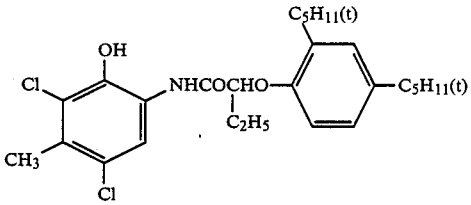
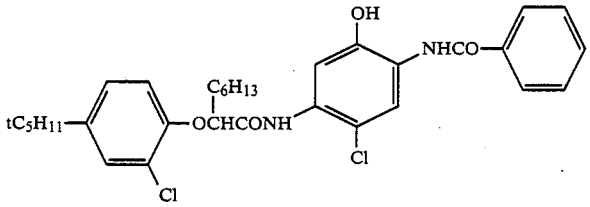
5/8/9 (by weight) mixture of the following compounds
Color Image Stabilizer (m):
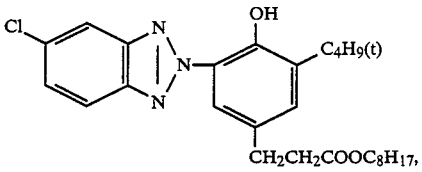

-continued

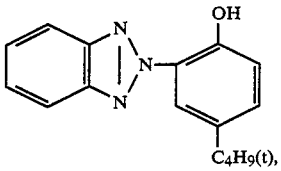

$C_4H_9(t)$, and

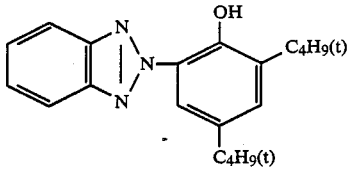

Average molecular weight: 35,000

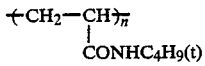

Polymer (n):

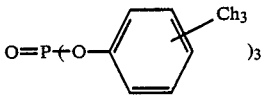

Solvent (o):

The multilayer color photographic paper prepared as above was, after being wedgewise exposed, processed in accordance with the following processing steps where the composition of the color developer was varied.

| Processing Step | Temperature | Time |
|---|---|---|
| Color Development | 35° C. | 45 sec |
| Bleach-fixing | 35° C. | 45 sec |
| Stabilization (1) | 35° C. | 20 sec |
| Stabilization (2) | 35° C. | 20 sec |
| Stabilization (3) | 35° C. | 20 sec |
| Stabilization (4) | 35° C. | 30 sec |
| Drying | 70–80° C. | 60 sec |

The stabilizing solution was run in a countercurrent flow system from the fourth tank to the first tank. The processing solutions used had the following compositions:

| Color Developer: | |
|---|---|
| Chelating Agent See Table 1 | $1 \times 10^{-2}$ mol |
| Brightening Agent See Table 1 | 3.0 g |
| Benzyl alcohol See Table 1 | |
| Diethylene Glycol See Table 1 | |
| Sodium Sulfite | 0.2 g |
| Potassium Carbonate | 30. g |
| Diethylhydroxylamine | 4.0 g |
| Triethylenedianine(1,4-bicyclo[2,2,2]octane) | 5.0 g |
| Sodium Chloride | 1.5 g |
| 4-Amino-3-methyl-N—ethyl-[β-(methanesulfonamido)ethyl]aniline Sulfate | 5.5 g |
| Water to make | 1000 ml |

-continued

| | |
|---|---|
| pH | 10.05 |
| Bleach-fixing Solution: | |
| EDTA Fe(III)$NH_4$.2$H_2O$ | 60 g |
| EDTA.2Na.2$H_2O$ | 4 g |
| Ammonium Thiosulfate (70 wt %) | 120 ml |
| Sodium Sulfite | 16 g |
| Ammonium Bromide | 30 g |
| Glacial Acetic Acid | 7 g |
| Water to make | 1000 ml |
| pH | 5.5 |
| Stabilizing Solution: | |
| Formalin (37 wt %) | 0.1 ml |
| 1-Hydroxyethylidene-1,1-diphosphonic Acid (60 wt %) | 1.6 ml |
| Bismuth Chloride | 0.35 g |
| Aqueous Ammonia (26 wt %) | 2.5 ml |
| Nitrilo-triacetic acid.3Na | 1.0 g |
| EDTA.4H | 0.5 g |
| Sodium Sulfite | 1.0 g |
| 5-Chloro-2-methyl-4-isothiazolin-3-one | 50 mg |
| Water to make | 1000 ml |

On the other hand, a part of the above-mentioned color developer was put in a 1 liter beaker and kept at 35° C. for 25 days in an open system, and then the thus aged solution was used in the above-mentioned processing procedure.

The experiment carried out using the color developer aged for 25 days (aged developer) was called an "aged developer test"; and the experiment carried out using the color developer not aged (fresh developer) was called a "fresh developer test".

The photographic characteristic (Dmin) results obtained with the fresh developer test and the aged developer test are shown in Table 1 below.

TABLE 1

| Test No. | Remarks | Benzyl Alcohol/ Diethylene Glycol (ml/ml) | Chelating Agent | Brightening Agent | Dmin (Fresh Developer) B | G | R | Dmin (Aged Developer) B | G | R |
|---|---|---|---|---|---|---|---|---|---|---|
| 1 | (Comparison) | 20/20 | (57) | Comparative Compound 1 | 0.10 | 0.14 | 0.10 | 0.20 | 0.19 | 0.15 |
| 2 | (Comparison) | 20/20 | (57) | Comparative | 0.10 | 0.14 | 0.10 | 0.20 | 0.18 | 0.15 |

TABLE 1-continued

| Test No. | Remarks | Benzyl Alcohol/ Diethylene Glycol (ml/ml) | Chelating Agent | Brightening Agent | Dmin (Fresh Developer) B | G | R | Dmin (Aged Developer) B | G | R |
|---|---|---|---|---|---|---|---|---|---|---|
| 3 | (Comparison) | — | (57) | Compound 2 Comparative | 0.10 | 0.13 | 0.10 | 0.19 | 0.17 | 0.14 |
| 4 | (Comparison) | — | EDTA | Compound 1 Comparative | 0.10 | 0.14 | 0.10 | 0.19 | 0.17 | 0.14 |
| 5 | (Comparison) | — | (68) | Compound 3 Comparative | 0.10 | 0.13 | 0.10 | 0.17 | 0.16 | 0.14 |
| 6 | (Comparison) | — | EDTA | Compound 3 I-5 | 0.09 | 0.14 | 0.10 | 0.17 | 0.17 | 0.14 |
| 7 | (The Invention) | 20/20 | (68) | I-2 | 0.10 | 0.14 | 0.10 | 0.15 | 0.16 | 0.11 |
| 8 | (The Invention) | 20/20 | (68) | I-5 | 0.10 | 0.14 | 0.10 | 0.15 | 0.16 | 0.11 |
| 9 | (The Invention) | 20/20 | (68) | I-17 | 0.10 | 0.14 | 0.10 | 0.15 | 0.16 | 0.11 |
| 10 | (The Invention) | — | (5) | I-5 | 0.10 | 0.14 | 0.10 | 0.13 | 0.15 | 0.11 |
| 11 | (The Invention) | — | (25) | I-5 | 0.10 | 0.13 | 0.10 | 0.13 | 0.15 | 0.12 |
| 12 | (The Invention) | — | (34) | I-5 | 0.10 | 0.14 | 0.10 | 0.13 | 0.15 | 0.12 |
| 13 | (The Invention) | — | (57) | I-5 | 0.10 | 0.14 | 0.10 | 0.12 | 0.16 | 0.12 |
| 14 | (The Invention) | — | (68) | I-2 | 0.09 | 0.13 | 0.10 | 0.12 | 0.14 | 0.11 |
| 15 | (The Invention) | — | (68) | I-5 | 0.09 | 0.13 | 0.10 | 0.10 | 0.13 | 0.10 |
| 16 | (The Invention) | — | (68) | I-11 | 0.10 | 0.14 | 0.10 | 0.12 | 0.16 | 0.11 |
| 17 | (The Invention) | — | (68) | I-17 | 0.10 | 0.14 | 0.10 | 0.12 | 0.16 | 0.11 |
| 18 | (The Invention) | — | (68) | I-23 | 0.10 | 0.14 | 0.10 | 0.12 | 0.16 | 0.11 |

Comparative Compound (1):

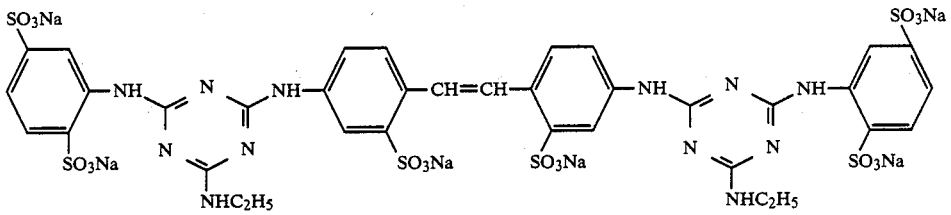

Comparative Compound (2):

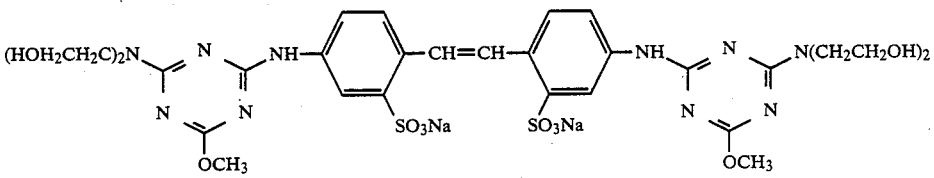

Comparative Compound (3):

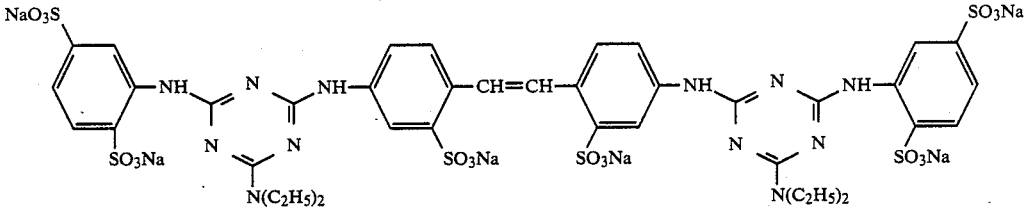

In the comparative examples, the value (Dmin) increased with the deterioration of the aged color developer, that is, the color photographic papers were noticeably stained, while in the examples of the present invention, staining of the color photographic papers was noticeably reduced. In particular, the effect was extremely good when the color photographic papers were processed with a benzyl alcohol-free developer (Test Nos. 10 to 18), and especially, the combination of the chelating agent (68) and the brightening agent I-5 (Test No. 15) was extremely excellent.

EXAMPLE 2

A photographic paper sample was prepared by forming the first layer (lowermost layer) to the seventh layer (uppermost layer) in order on a paper support both surfaces of which were coated with polyethylene, the support having been processed by corona-discharging. The compositions of the respective layers are shown below. The coating solutions for the layers were prepared as mentioned below. The structural formulae of the couplers, color image stabilizers and other compounds used for the preparation of the coating solutions are also mentioned below.

The coating solution for the first layer was prepared as follows:

A mixture formed by adding 600 ml of ethyl acetate as an auxiliary solvent to 200 g of Yellow Coupler, 93.3 g of Color Fading Preventing Agent (r), 10 g of High Boiling Point Solvent (p) and 5 g of Solvent (q) was heated to 60° C. and dissolved, and then the resulting solution was blended with 3300 ml of an aqueous 5% gelatin solution containing 330 ml of an aqueous 5% solution of Alkanol B (trade name, alkylnaphthalene sulfonate, manufactured by DuPont). Next, this solution was emulsified with a colloid mill to obtain a coupler dispersion. The ethyl acetate was removed by evaporation under reduced pressure from the resulting dispersion, and the resulting dispersion was added to 1,400 g of an emulsion to which a sensitizing dye for a blue-sensitive emulsion layer and 1-methyl-2-mercapto-5-acetylamino-1,3,4-triazole had been added, the emulsion containing 96.7 g of Ag and 170 g of gelatin. Further, 2,600 g of an aqueous 10% gelatin solution was added thereto, to obtain the coating solution for the first layer. The coating solutions for the other second to seventh layers were also prepared in accordance with the preparation of the solution for the first layer.

As the cyan coupler for the fifth layer, the cyan coupler shown in Table 2 below was used. Thus, various kinds of photographic papers were prepared.

The compositions of the layers were as follows. A paper support both surfaces of which were coated with polyethylene was used as the support.

| | |
|---|---|
| First Layer: Blue-sensitive Emulsion Layer | |
| Silver Chlorobromide Emulsion | 290 mg/m$^2$ as Ag |
| (silver bromide 1 mol %) | |
| Yellow Coupler (a) | 600 mg/m$^2$ |
| Color Fading Preventing Agent (r) | 280 mg/m$^2$ |
| Solvent (p) | 30 mg/m$^2$ |
| Solvent (q) | 15 mg/m$^2$ |
| Gelatin | 1800 mg/m$^2$ |
| Second Layer: Color Stain Preventing Layer | |
| Silver Bromide Emulsion (primitive | 10 mg/m$^2$ as Ag |
| (emulsion, grain size 0.5 μm) | |
| Color Stain Preventing Agent (s) | 55 mg/m$^2$ |
| Solvent (p) | 30 gg/m$^2$ |
| Solvent (q) | 15 mg/m$^2$ |
| Gelatin | 800 mg/m$^2$ |
| Third Layer: Green-sensitive Emulsion Layer | |
| Silver Chlorobromide Emulsion | 305 mg/m$^2$ as Ag |
| (silver bromide 0.5 mol %) | |
| Magenta Coupler | 670 mg/m$^2$ |
| Color Fading Preventing Agent (t) | 150 mg/m$^2$ |
| Color Fading Preventing Agent (u) | 10 mg/m$^2$ |
| Solvent (p) | 200 mg/m$^2$ |
| Solvent (q) | 10 mg/m$^2$ |
| Gelatin | 1400 mg/m$^2$ |
| Fourth Layer: Color Stain Preventing Layer | |
| Color Stain Preventing Agent (s) | 65 mg/m$^2$ |
| Ultraviolet Absorbent (n) | 450 mg/m$^2$ |
| Ultraviolet Absorbent (o) | 230 mg/m$^2$ |
| Solvent (p) | 50 mg/m$^2$ |
| Solvent (q) | 50 mg/m$^2$ |
| Fifth Layer: Red-sensitive Emulsion Layer | |

-continued

| | |
|---|---|
| Silver Chlorobromide Emulsion | 210 mg/m$^2$ as Ag |
| (silver bromide 1 mol %) | |
| Cyan Coupler (see Table 2) | $5 \times 10^{-4}$ mol/m$^2$ |
| Color Fading Preventing Agent (r) | 250 mg/m$^2$ |
| Solvent (p) | 160 mg/m$^2$ |
| Solvent (q) | 100 mg/m$^2$ |
| Gelatin | 1800 mg/m$^2$ |
| Sixth Layer: Ultraviolet Absorbing Layer | |
| Ultraviolet Absorbent (n) | 260 mg/m$^2$ |
| Ultraviolet Absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Seventh Layer: Protective Layer | |
| Gelatin | 600 mg/m$^2$ |

The compounds used in the Example 2 were as follows:

Ultraviolet Absorbent (n):
2-(2-Hydroxy-3,5-di-tert-amylphenyl)benzotriazole

Ultraviolet Absorbent (o):
2-(2-Hydroxy-3,5-di-tert-butylphenyl)benzotriazole

Solvent (p):
Di(2-ethylhexyl)phthalate

Solvent (q):
Dibutyl Phthalate

Color Fading Preventing Agent (r):
2,5-Di-tert-amylphenyl-3,5-di-tert-butylhydroxylbenzoate Color Stain Preventing Agent (s):
2,5-Di-tert-octylhydroquinone Color Fading Preventing Agent (t):
1,4-Di-tert-Amyl-2,5-dioctyloxybenzene Color Fading Preventing Agent (u):
2,2'-Methylenebis-(4-methyl-6-tert-butylphenol)

The following compounds were used as the sensitizing dyes for the respective emulsion layers.

Blue-sensitive Emulsion Layer:
Anhydro-5-methoxy-5'-methyl-3,3'-disulfopropylselenacyanine-hydroxide Green-sensitive Emulsion Layer:
Anhydro-9-ethyl-5,5'-diphenyl-3,3'-disulfoethyloxacarbocyanine-hydroxide Red-sensitive Emulsion Layer:
3,3'-Diethyl-5-methoxy-9,9'-(2,2-dimethyl-1,3-propano)thiadicarbocyanine-iodide The following compound was used as the stabilizer for the respective emulsion layers.
1-Methyl-2-mercapto-5-acetylamino-1,3,4-triazole The following compounds were used as the irradiation preventing dyes:
4-(3-Carboxy-5-hydroxy-4-(3-(3-carboxy-5-oxo-1-(4-sulfonatophenyl)-2-pyrazolin-4-ylidene)-1-propenyl)-1-pyrazolyl)benzenesulfonate-dipotassium salt, and N,N'-(4,8-dihydroxy-9,10-dioxo-3,7-disulfonatoanthracene-1,5-diyl)bis(aminomethanesulfonato)-tetrasodium salt As the hardener, 1,2-bis(binylsulfonyl)ethane was used in the respective layers.

The couplers used were as follows:

Yellow Coupler:

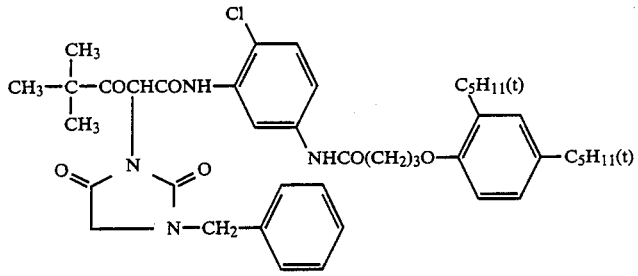

Magenta Coupler:

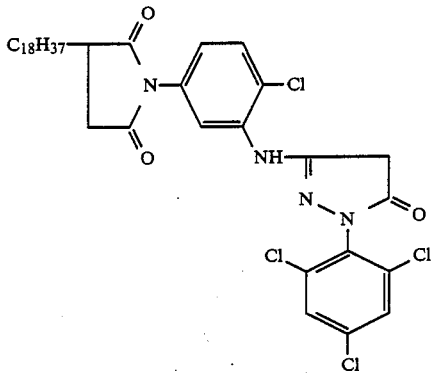

Cyan Coupler: See Table 2

The multilayer color photographic paper thus prepared was, after being wedgewise exposed, processed in accordance with the following processing steps, where the processing time in the bleach-fixing step and that in the rinsing step were varied as indicated in Table 2 below.

| Processing Steps | Time | Temperature |
|---|---|---|
| Color Development | 45 sec | 35° C. |
| Bleach-fixing | see Table 2 | 35° C. |
| Rinsing (3 tank cascade) | see Table 2 | 35° C. |
| Drying | 60 sec | 70° C. |

The processing solutions used had the following compositions:

| | |
|---|---|
| Color Developer: | |
| Chelating Agent See Table 2 | $1 \times 10^{-2}$ mol |
| Brightening Agent See Table 2 | 3.0 g |
| Potassium Carbonate | 30 g |
| Diethylhydroxylamine | 4.0 g |
| Triethanolamine | 10.0 g |
| Sodium Chloride | 1.5 g |
| 4-Amino-3-methyl-N—ethyl-N—[β-(methanesulfonamido)ethyl]aniline Sulfate | 5.5 g |
| Water to make | 1000 ml |
| pH | 10.05 |
| Bleach-fixing Solution: | |
| Ammonium Thiosulfate (70 wt %) | 150 ml |
| Sodium Sulfite | 15 g |

-continued

| | |
|---|---|
| Ammonium Ethylenediamine-tetraacetic Acid Iron(III) | 60 g |
| Ethylenediamine-tetraacetic Acid | 10 g |
| Brightening Agent (4,4'-diamino stilbene-type) | 1.0 g |
| 2-Mercapto-5-amino-3,4-thiadiazole | 1.0 g |
| Water to make | 1000 ml |
| Aqueous Ammonia to make pH | 7.0 |
| Rinsing Solution: | |
| Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth Chloride (40 wt %) | 0.5 g |
| Nitrilo-N,N,N—trimethylenephosphonic Acid (40 wt %) | 1.0 g |
| 1-Hydroxyethylidene-1,1-diphosphonic Acid (60 wt %) | 2.5 g |
| Brightening Agent (4,4'-diamino-stilbene-type) | 1.0 g |
| Aqueous Ammonia (26 wt %) | 2.0 ml |
| Water to make | 1000 ml |
| KOH to make pH | 7.5 |

In the same manner as Example 1, a part of the above-mentioned color developer was aged for 21 days, and the fresh color developer and the aged color developer were used for processing of the color photographic papers. After processing, the value of Dmin of cyan was measured in the respective samples.

The increase of Dmin of the sample processed by the aged developer with respect to that processed by the fresh developer is shown in Table 2.

TABLE 2

| Test No. | Processing Time 1 Bleach-fixing | 2 Rinsing | 3 1 + 2 | Cyan Coupler* | Chelating Agent | Brightening Agent | Fluctuation of Photographic Property (Dmin) | Remarks |
|---|---|---|---|---|---|---|---|---|
| 1 | 45 sec | 1 min 30 sec | 2 min 15 sec | C-9 | (68) | Comparative Compound (3)** | +0.08 | Comparison |
| 2 | 45 sec | 1 min 30 sec | 2 min 15 sec | C-1 | EDTA | I-5 | +0.07 | " |
| 3 | 1 min | 3 min | 4 min | C-9 | (68) | Comparative Compound (3)** | +0.04 | " |
| 4 | 1 min | 3 min | 4 min | Coupler (A) | (68) | I-5 | +0.02 | The Invention |

TABLE 2-continued

| Test No. | Processing Time 1 Bleach-fixing | 2 Rinsing | 3 1 + 2 | Cyan Coupler* | Chelating Agent | Brightening Agent | Fluctuation of Photographic Property (Dmin) | Remarks |
|---|---|---|---|---|---|---|---|---|
| 5 | " | " | " | Coupler (B) | " | " | +0.02 | " |
| 6 | " | " | " | C-9 | " | " | 0 | " |
| 7 | " | " | " | C-1 | " | " | 0 | " |
| 8 | 45 sec | 1 min 30 sec | 2 min 15 sec | Coupler (A) | " | " | +0.03 | " |
| 9 | " | " | " | Coupler (B) | " | " | +0.03 | " |
| 10 | " | " | " | C-1 | " | " | 0 | " |
| 11 | " | " | " | C-1 | " | " | 0 | " |
| 12 | 45 sec | 1 min | 1 min 45 sec | C-1 | (68) | I-5 | +0.01 | The Invention |
| 13 | " | " | " | Coupler (A) | " | " | +0.03 | " |
| 14 | " | " | " | C-1 | (5) | " | +0.02 | " |
| 15 | " | " | " | " | (25) | I-11 | +0.02 | " |
| 16 | " | " | " | " | (37) | " | +0.02 | " |
| 17 | " | " | " | " | EDTA | I-5 | +0.09 | Comparison |
| 18 | " | " | " | " | (68) | Comparative Compound (3)** | +0.11 | " |

*Cyan Coupler:

(A)

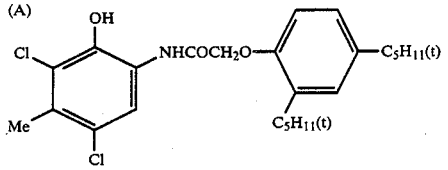

Me: $CH_3$ (B)

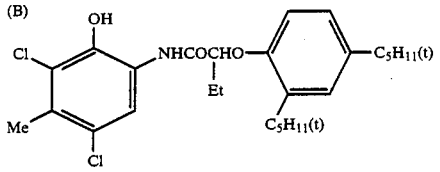

Me: $CH_3$
Et: $C_2H_5$
**Same as Example 1

In the comparative samples, the increase of Dmin of cyan was substantial with the shortening of the bleach-fixing step and the rinsing step (Test Nos. 1, 2, 3, 17 and 18); while the samples of the present invention were almost free of an increase of Dmin and, therefore, the samples could be processed satisfactorily by rapid processing. In addition, the effect of the present invention was more remarkable when the specifically defined cyan coupler of the present invention was used.

EXAMPLE 3

A multilayer color photographic paper was prepared by forming the layers having the composition shown below on a paper support both surfaces of which were coated with polyethylene. The coating compositions for the layers were prepared as follows.

Coating Composition for the First Layer:

27.2 ml of ethyl acetate and 7.7 ml of Solvent (c) were added to 19.19 g of Yellow Coupler (a) and 4.4 g of Color Image Stabilizer (b) and dissolved, and the resulting solution was dispersed by emulsification in 185 ml of an aqueous 10 wt % gelatin solution containing 8 ml of a 10 wt % sodium dodecylbenzenesulfonate solution. On the other hand, a silver chlorobromide emulsion (containing 90.0 mol % silver bromide and 70 g/kg of silver) containing the blue-sensitive sensitizing dye shown below in an amount of $5.0\times10^{-4}$ mol per mol of silver was prepared. The emulsified dispersion prepared above was mixed with the aforesaid silver halide emulsion and dissolved, and the coating solution for the first layer (lowermost layer), having the composition shown below, was prepared. Coating compositions for the second layer to the seventh layer (uppermost layer) were also prepared in the same manner as the first layer. As a gelatin hardening agent for each layer, 1-hydroxy-3,5-dichloro-s-triazine sodium salt was used.

The following spectral sensitizing dyes were used for the respective layer.

Blue-sensitive Emulsion Layer:

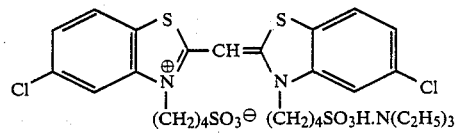

($5.0\times10^{-4}$ mol per mol of silver halide)

Green-sensitive Emulsion Layer:

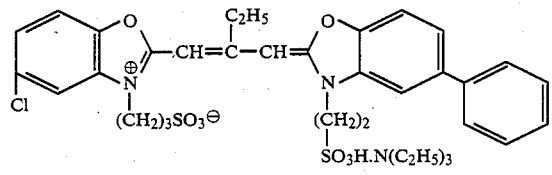

($4.0\times10^{-4}$ mol per of silver halide) and

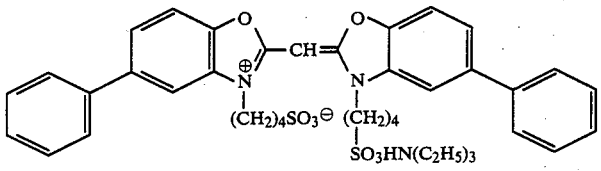

($7.0\times10^{-5}$ mol per mol of silver halide)

Red-sensitive Emulsion Layer:

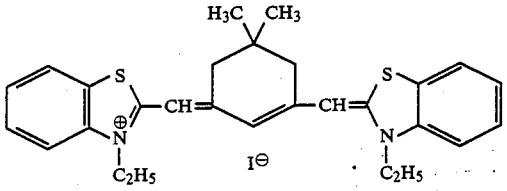

($0.9\times10^{-4}$ mol per mol of silver halide)

For the red-sensitive emulsion layer, the following compound was added in an amount of $2.6\times10^{-3}$ mol per mol of silver halide.

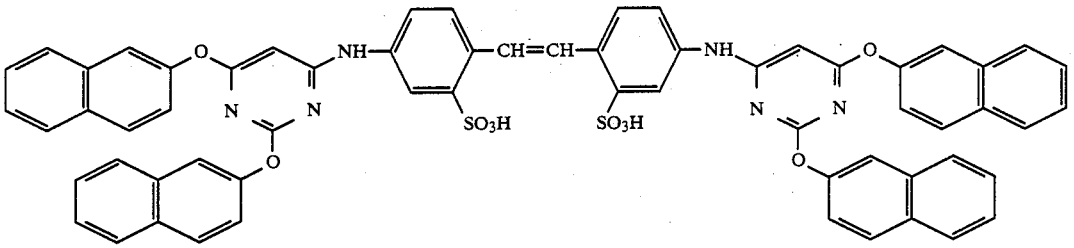

For the blue-sensitive emulsion layer, the green-sensitive emulsion layer and the red-sensitive emulsion layer, 1-(5-methylureidophenyl)-5-mercaptotetrazole was added to each in an amount of $8.5\times10^{-5}$ mol, $7.7\times10^{-4}$ mol and $2.5\times10^{-4}$ mol, respectively, per mol of silver halide.

In addition, for the blue-sensitive emulsion layer and green-sensitive emulsion layer, 4-hydroxy-6-methyl-1,3,3a,7-tetrazaindene was added to each in an amount of $1.2\times10^{-2}$ mol and $1.1\times10^{-2}$ mol, respectively, per mol of silver halide.

The following dyes were added to the emulsion layer for preventing irradiation.

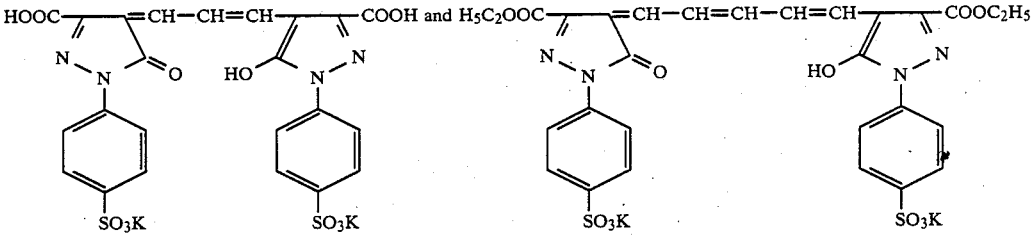

The compositions of the layers were as follows. In addition, the polyethylene coated paper contained titanium dioxide as a white pigment and ultramarine as a bluish dye in the side having the first layer.

| | |
|---|---|
| First Layer: Blue-sensitive Emulsion Layer | |
| Silver Chlorobromide Emulsion (silver bromide 90 mol %) | 0.26 g/m² as Ag |
| Gelatin | 1.83 g/m² |
| Yellow Coupler (a) | 0.83 g/m² |
| Color Image Stabilizer (b) | 0.19 g/m² |
| Solvent (c) | 0.35 g/m² |
| Second Layer: Color Stain Preventing Layer | |
| Gelatin | 0.99 g/m² |
| Color Stain Preventing Agent (d) | 0.08 g/m² |
| Third Layer: Green-sensitive Emulsion Layer | |
| Silver Chlorobromide Emulsion (silver bromide 80 mol %) | 0.16 g/m² as Ag |
| Gelatin | 1.79 g/m² |
| Magenta Coupler (e) | 0.32 g/m² |
| Color Image Stabilizer (f) | 0.20 g/m² |
| Color Image Stabilizer (g) | 0.01 g/m² |
| Solvent (h) | 0.65 g/m² |
| Fourth Layer: Ultraviolet Absorbing Layer | |
| Gelatin | 1.58 g/m² |
| Ultraviolet Absorbent (i) | 0.62 g/m² |
| Color Stain Preventing Agent (j) | 0.05 g/m² |
| Solvent (k) | 0.24 g/m² |
| Fifth Layer: Red-sensitive Emulsion Layer | |
| Silver Chlorobromide Emulsion (silver bromide 70 mol %) | 0.23 g/m² as Ag |
| Gelatin | 1.34 g/m² |
| Cyan Coupler (l) | 0.34 g/m² |
| Color Image Stabilizer (m) | 0.17 g/m² |
| Polymer (n) | 0.40 g/m² |
| Solvent (o) | 0.23 g/m² |
| Sixth Layer: Ultraviolet Absorbing Layer | |
| Gelatin | 0.53 g/m² |
| Ultraviolet Absorbent (i) | 0.21 g/m² |
| Solvent (k) | 0.08 g/m² |
| Seventh Layer: Protective Layer | |
| Gelatin | 1.33 g/m² |
| Acryl-modified Polyvinyl Alcohol Copolymer (modification degree of 17%) | 0.17 g/m² |

-continued
| | |
|---|---|
| Liquid Paraffin | 0.03 g/m$^2$ |
The couplers and other compounds used in Example 3 have the following structural formulae.
Yellow Coupler (a):
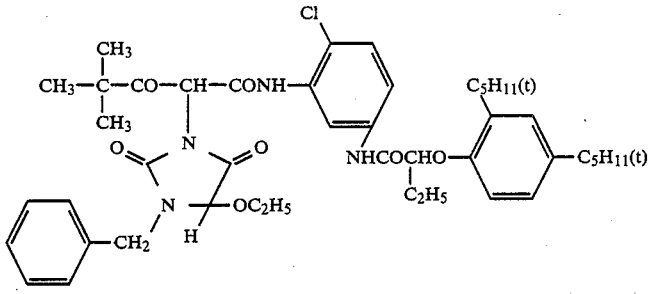
Color Image Stabilizer (b):
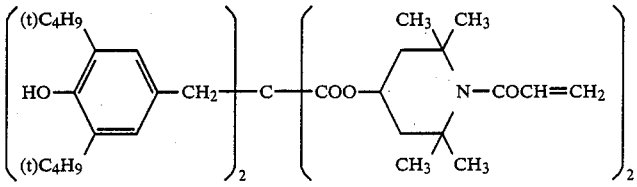
Solvent (c)
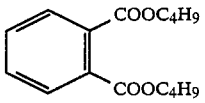
Color Stain Preventing Agent (d):
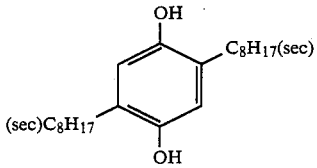
Magenta Coupler (e):
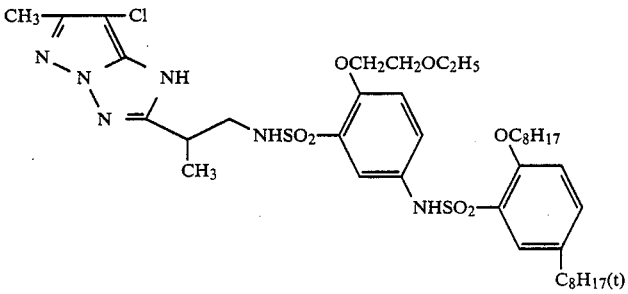
Color Image Stabilizer (f):
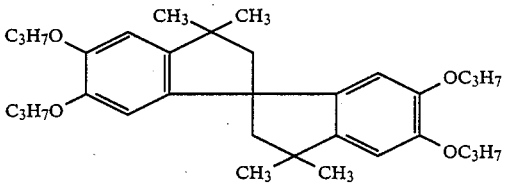

Color Image Stabilizer (g):
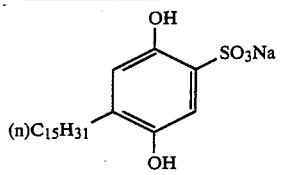
-continued
Solvent (h):
2/1 (by volume) mixture of the following compounds
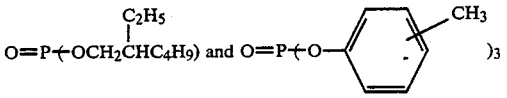
Ultraviolet Absorbent (i):
2/9/8 (by weight) mixture of the following compounds
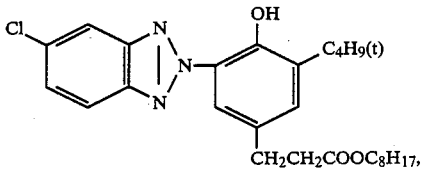
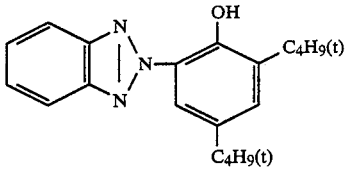
and
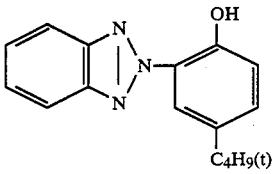
Color Stain Preventing Agent (j):
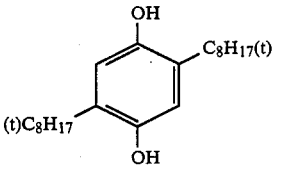
Solvent (k):
$O{=}P{\leftarrow}O{-}C_9H_{19}(iso))_3$
Cyan Coupler (l):
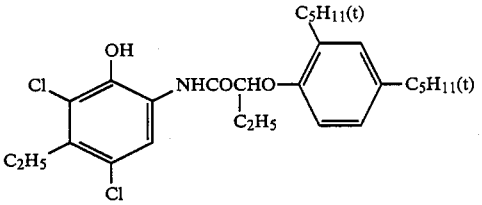

-continued

Color Image Stabilizer (m):

5/8/9 (by weight) mixture of the following compounds

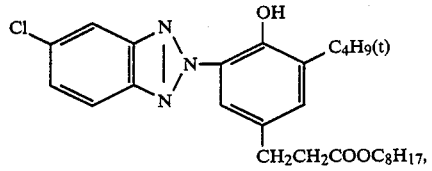

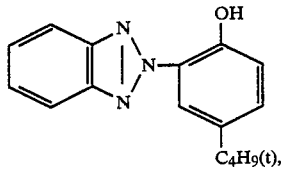

and

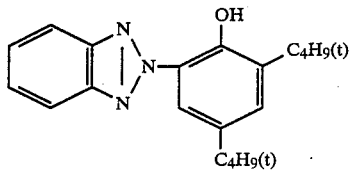

Polymer (n):

Mean Molecular Weight: 35,000

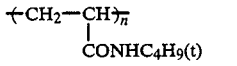

Solvent (o):

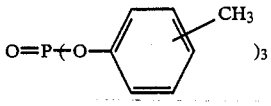

The multilayer color photographic paper prepared above was, after being imagewise exposed, processed in accordance with the following processing steps where the composition of the color developer was varied and the amount of the rinsing replenisher was also varied. Processing was carried out continuously for the running test until the replenisher replenished two times the tank capacity of the color developer tank.

| Processing Step | Temperature (°C.) | Time | Amount of Replenisher (ml/m²) |
|---|---|---|---|
| Color Development | 38 | 1 min 40 sec | 290 |
| Bleach-fixing | 30–34 | 1 min 00 sec | 150 |
| Rinsing (1) | 30–34 | 20 sec | — |
| Rinsing (2) | 30–34 | 20 sec | — |
| Rinsing (3) | 30–34 | 20 sec | See Table 3 |
| Drying | 70–80 | 50 sec | |

The rinsing solution was run in a countercurrent flow system from the third tank to the first tank.

The amount of the processing solution carried over into the tank from the previous tank together with the material being processed was 30 ml per m² of the material.

The processing solutions used had the following compositions.

| | Tank Solution | Replenisher |
|---|---|---|
| Color Developer: | | |

-continued

| | Tank Solution | Replenisher |
|---|---|---|
| Water | 800 ml | 800 ml |
| Chelating Agent (see Table 3) | $1 \times 10^{-2}$ mol | $1 \times 10^{-2}$ mol |
| Triethylenediamine(1,4-bicyclo[2,2,2]octane) | 5.0 g | 5.0 g |
| Potassium Bromide | 0.5 g | — |
| Potassium Carbonate | 30 g | 30 g |
| N—ethyl-N—(β-methanesulfonamidoethyl)-3-methyl-4-aminoaniline Sulfate | 5.5 g | 7.5 g |
| N,N—diethylhydroxylamine Sulfate | 4.0 g | 6.0 g |
| Brightening Agent (see Table 3) | 1.5 g | 2.5 g |
| Water to make | 1000 ml | 1000 ml |
| pH (25° C.) | 10.25 | 10.60 |
| Bleach-Fixing Solution: | | |
| Water | 400 ml | 400 ml |
| Ammonium Thiosulfate (70 wt %) | 200 ml | 200 ml |
| Sodium Sulfite | 20 g | 40 g |
| Ammonium Ethylenediamine-tetraacetic Acid Iron(III) | 60 g | 120 g |
| Ethylenediamine-tetraacetic Acid Di-sodium Salt | 10 g | 20 g |
| Water to make | 1000 ml | 1000 ml |
| pH (25° C.) | 7.00 | 6.30 |

Rinsing Solution: (Tank solution and replenisher were same.) Ion-exchanged Water (Calcium content and magnesium content each were 3 ppm or less.)

After processing, the value of Dmin of each sample was measured. In addition, the samples were kept for one month at 60° C. and 70% RH, and the value of Dmin of each of the thus aged samples was measured. Next, an area of the sample having a magenta density of 2.0 was exposed with an 80,000 lux xenon lamp for 15 days, and the decrease in the magenta density was also measured. The density was measured with a Macbeth densitometer. The results obtained are shown in Table 3 below.

TABLE 3

| Test No. | Rinsing Replenisher* (ml/m²) | Chelating Agent | Brightening Agent | Remarks | Dmin After Processed B | Dmin After Processed G | Dmin After Processed R | Dmin After Aged B | Dmin After Aged G | Dmin After Aged R | Magenta Density D = 2.0 |
|---|---|---|---|---|---|---|---|---|---|---|---|
| 1 | 12, 0.4 | (68) | Comparative Compound (1)** | Comparison | 0.28 | 0.20 | 0.15 | 0.45 | 0.30 | 0.27 | 1.39 |
| 2 | 300, 10 | (68) | Comparative Compound (1)** | Comparison | 0.19 | 0.18 | 0.13 | 0.35 | 0.27 | 0.23 | 1.43 |
| 3 | 300, 10 | Propylenediamine-tetraacetic Aced | I-5 | Comparison | 0.19 | 0.18 | 0.44 | 0.35 | 0.26 | 0.22 | 1.47 |
| 4 | 3000, 100 | (68) | Comparative Compound (1)* | Comparsion | 0.19 | 0.14 | 0.13 | 0.35 | 0.24 | 0.19 | 1.56 |
| 5 | 12, 0.4 | (68) | I-5 | The Invention | 0.14 | 0.16 | 0.12 | 0.27 | 0.21 | 0.16 | 1.68 |
| 6 | 90, 3 | (68) | I-5 | The Invention | 0.11 | 0.15 | 0.11 | 0.23 | 0.19 | 0.15 | 1.83 |
| 7 | 300, 10 | (68) | I-5 | The Invention | 0.10 | 0.14 | 0.10 | 0.23 | 0.18 | 0.15 | 1.90 |
| 8 | 600, 20 | (68) | I-5 | The Invention | 0.10 | 0.14 | 0.10 | 0.23 | 0.19 | 0.15 | 1.91 |
| 9 | 1200, 40 | (68) | I-5 | The Invention | 0.10 | 0.14 | 0.10 | 0.22 | 0.19 | 0.15 | 1.86 |
| 10 | 3000, 100 | (68) | I-5 | The Invention | 0.10 | 0.14 | 0.10 | 0.22 | 0.19 | 0.15 | 1.70 |
| 11 | 90, 3 | (57) | I-5 | The Invention | 0.13 | 0.16 | 0.12 | 0.27 | 0.21 | 0.16 | 1.81 |
| 12 | 300, 10 | (57) | I-5 | The Invention | 0.12 | 0.15 | 0.12 | 0.24 | 0.19 | 0.16 | 1.89 |
| 13 | 600, 20 | (57) | I-5 | The Invention | 0.11 | 0.15 | 0.11 | 0.24 | 0.19 | 0.15 | 1.68 |
| 14 | 3000, 100 | (57) | I-5 | The Invention | 0.11 | 0.15 | 0.11 | 0.24 | 0.19 | 0.15 | 1.68 |
| 15 | 90, 3 | (68) | I-2 | The Invention | 0.13 | 0.16 | 0.12 | 0.26 | 0.20 | 0.16 | 1.79 |
| 16 | 300, 10 | (68) | I-2 | The Invention | 0.12 | 0.15 | 0.11 | 0.25 | 0.19 | 0.16 | 1.88 |
| 17 | 600, 20 | (68) | I-2 | The Invention | 0.12 | 0.15 | 0.11 | 0.24 | 0.18 | 0.15 | 1.87 |
| 18 | 3000, 100 | (68) | I-2 | The Invention | 0.12 | 0.15 | 0.11 | 0.24 | 0.19 | 0.15 | 1.69 |

*Amount of Replenisher/Amount of Solution as carried over into from the Previous Bath

**Same as Example 1

When processing was conducted according to the present invention, the degree of staining of the processed samples and that of the aged samples was low and the results obtained were favorable. Moreover, when the rinsing replenisher was supplied in an amount within the range of from 3 to 40 times the amount of the processing solution brought into the rinsing tank from the previous tank together with the material being processed, the color fading of the magenta color was noticeably reduced.

EXAMPLE 4

Samples were prepared in the same manner as the Test Nos. 1 to 18 of Example 1, except that the color photographic paper prepared by the following procedures was used in place of the color photographic paper of Example 1.

The multilayer color photographic paper was prepared by forming the layers having the compositions shown below on a paper support both surfaces of which were coated with polyethylene. The coating solutions were prepared by blending and dissolving an emulsion, various chemicals and an emulsified dispersion of a coupler, and the method for the preparation of the solution is mentioned below.

Preparation of Coupler Emulsion:

27.2 ml of ethyl acetate and 7.7 ml of solvent (Solv-1) were added to 19.1 g of Yellow Coupler (ExY) and 4.4 g of Color Image Stabilizer (Cpd-1) and dissolved, and the resulting solution was dispersed by emulsification in 185 ml of an aqueous 10 wt % gelatin solution containing 8 ml of a 10 wt % sodium dodecylbenzenesulfonate solution.

The other emulsions for magenta and cyan layers and interlayer were prepared in the same manner. The compounds used for the preparation of the emulsions are mentioned below.

Yellow Coupler (ExY):

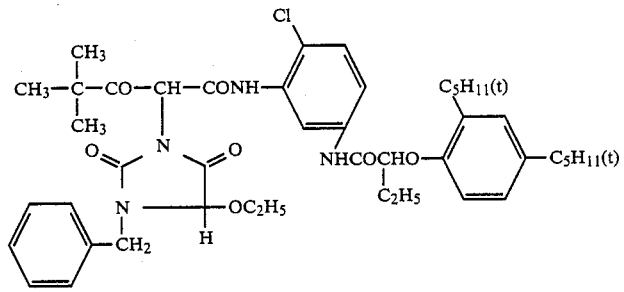

-continued
Magenta Coupler (ExM1):
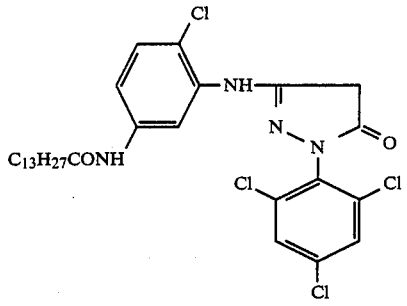
Cyan Coupler (ExC1):
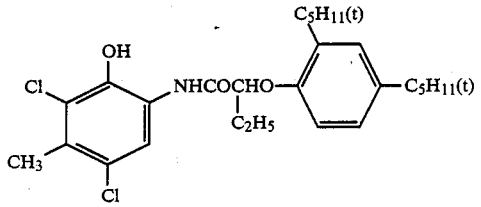
Cyan Coupler (ExC2):
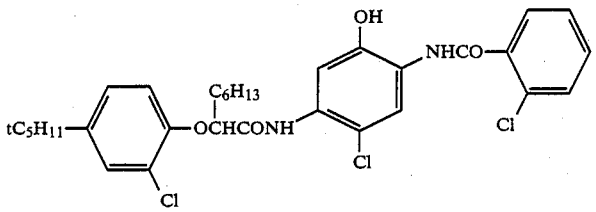
Color Image Stabilizer (Cpd-1):
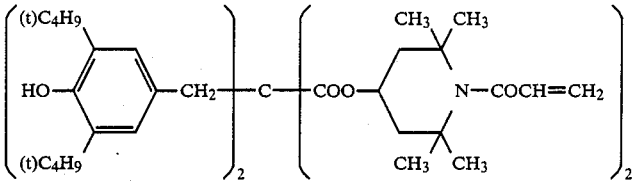
Color Stain Preventing Agent (Cpd-2):
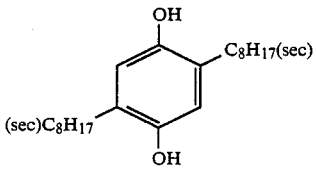
Color Stain Preventing Agent (Cpd-3):
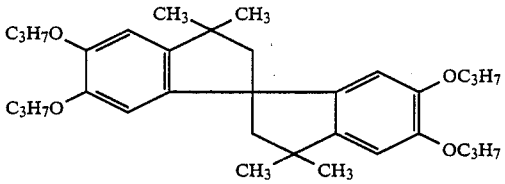

-continued

Color Stain Preventing Agent (Cpd-4):

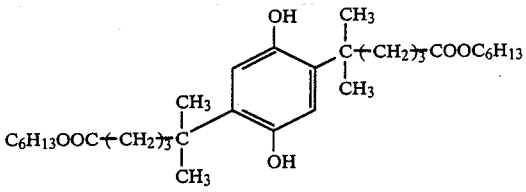

Color Stain Preventing Agent (Cpd-5):
Same as (Cpd-2), provided that $R=C_8H_{17}(t)$
Color Image Stabilizer (Cpd-6):
5/8/9 (by weight) mixture of the following compounds (6a), (6b) and (6c) (6a)

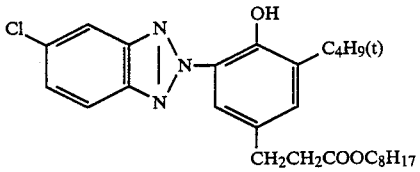

(6b)

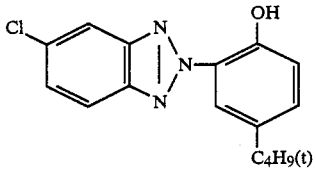

(6c)

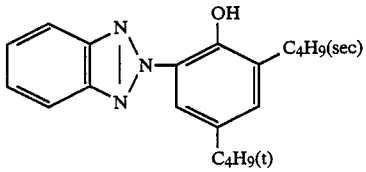

Polymer (Cpd-7):
Average Molecular Weight 80,000

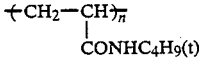

UV Absorbent (UV-1):
2/9/8 (by weight) mixture of compounds (Cpd-6a), (Cpd-6b) and (Cpd-6c) above
Solvent (Solv-1):

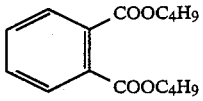

Solvent (Solv-2):

$O{=}P{-}(O{-}C_8H_{17}(iso))_3$

Solvent (Solv-3):
$O{=}P{-}(O{-}C_9H_{19}(iso))_3$

Solvent (Solv-4):

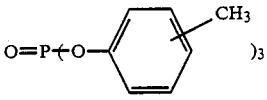

The following dyes were added to the emulsion layers for preventing irradiation.
Red-sensitive Emulsion Layer: Dye-R

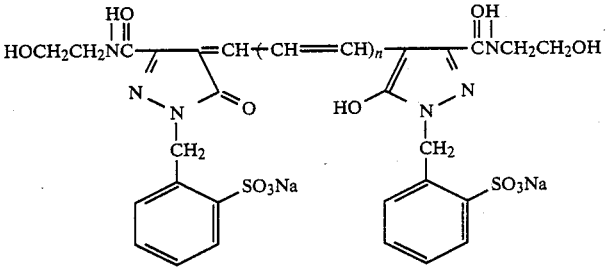

(n = 2)

Green-sensitive Emulsion Layer:
Same as Dye-R, provided that n=1.
To the red-sensitive emulsion layer was added the following compound in an amount of $2.6\times10^{-3}$ mol per mol of silver halide.

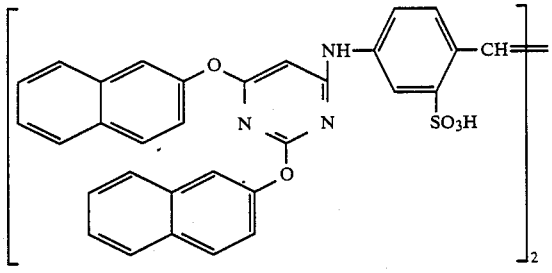

Next, the emulsions used in Example 4 are shown below.
Blue-sensitive Emulsion:

A monodispersed cubic silver chloride emulsion (containing $K_2IrCl_6$ and 1,3-dimethylimidazoline-2-thione), having a mean grain size of 1.1 μm and a variation coefficient (standard deviation/mean grain diameter size, s/d) of 0.10, was prepared in a conventional manner. 26 ml of a 0.6 wt % solution containing Blue-sensitive Spectral Sensitizing Dye (S-1) was added to 1.0 kg of the emulsion thus prepared, and in addition, a fine silver bromide grain emulsion having a mean grain size of 0.05 μm was added thereto in a proportion of 0.5 mol % on the basis of the host silver chloride emulsion. Next, this emulsion was ripened and then sodium thiosulfate was added thereto for optimum chemical sensitization. Stabilizer (Stb-1) was further added thereto in an amount of $10^{-4}$ mol per mol of silver, to obtain the intended blue-sensitive emulsion.

Green-sensitive Emulsion:

Silver chloride grains containing $K_2IrCl_6$ and 1,3-dimethylimidazoline-2-thione were prepared in a conventional manner, and then $4\times10^{-4}$ mol/mol-Ag of Sensitizing Dye (S-2) and KBr were added thereto and ripened, and then sodium thiosulfate was further added thereto for optimum chemical sensitization. Next, $5\times10^{-4}$ mol/mol-Ag of Stabilizer (Stb-1) was added, to obtain a monodispersed cubic silver chloride emulsion having a mean grain size of 0.48 μm and a variation coefficient of 0.10.

Red-sensitive Emulsion:

This was prepared in the same manner as the above-mentioned green-sensitive emulsion, except that Sensitizing Dye (S-3) was used in place of (S-2) in an amount of $1.5\times10^{-4}$ mol/mol-Ag.

The compounds used in the preparation of the above-mentioned emulsions are shown below.

Sensitizing Dye (S-1):

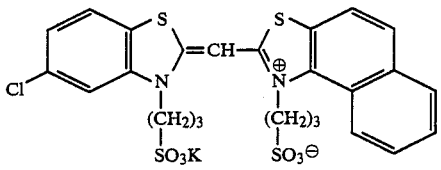

Sensitizing Dye (S-2):

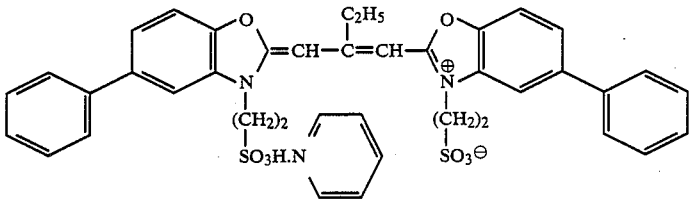

Sensitizing Dye (S-3):

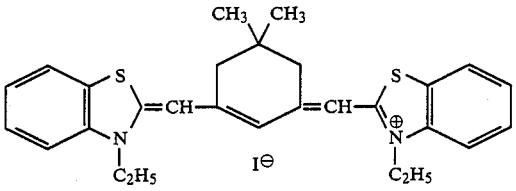

Stabilizer (Stb-1):

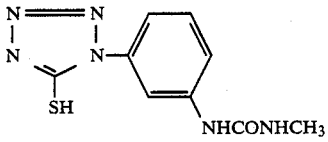

The compositions of the layers were as follows. As the support, the polyethylene coated paper contained titanium dioxide as a white pigment and ultramarine as a bluish dye in the side having the first layer.

| | |
|---|---|
| First Layer (lowermost layer): | |
| Blue-sensitive Emulsion Layer | |
| Silver Halide Emulsion | 0.30 g/m² as Ag |
| Gelatin | 1.86 g/m² |
| Yellow Coupler (ExY) | 0.82 g/m² |
| Color Image Stabilizer (Cpd-1) | 0.19 g/m² |
| Solvent (Solv-1) | 0.35 g/m² |
| Second Layer: Color Stain Preventing Layer | |
| Gelatin | 0.99 g/m² |
| Color Stain Preventing Agent (Cpd-2) | 0.08 g/m² |
| Third Layer: Green-sensitive Emulsion Layer | |
| Silver Halide Emulsion | 0.36 g/m² as Ag |
| Gelatin | 1.24 g/m² |
| Magenta Coupler (ExMl) | 0.31 g/m² |
| Color Image Stabilizer (Cpd-3) | 0.25 g/m² |
| Color Image Stabilizer (Cpd-4) | 0.12 g/m² |
| Solvent (Solv-2) | 0.42 g/m² |
| Fourth Layer: Ultraviolet Absorbing Layer | |
| Gelatin | 1.58 g/m² |
| Ultraviolet Absorbent (UV-1) | 0.62 g/m² |
| Color Stain Preventing Agent (Cpd-5) | 0.05 g/m² |
| Solvent (Solv-3) | 0.24 g/m² |
| Fifth Layer: Red-sensitive Emulsion Layer | |
| Silver Halide Emulsion | 0.23 g/m² as Ag |
| Gelatin | 1.34 g/m² |
| Cyan Coupler (1/1 (by mol) mixture of | 0.34 g/m² |

-continued

| | |
|---|---|
| of ExCl and ExC2) | |
| Color Image Stabilizer (Cpd-6) | 0.17 g/m$^2$ |
| Polymer (Cpd-7) | 0.40 g/m$^2$ |
| Solvent (Solv-4) | 0.23 g/m$^2$ |
| Sixth Layer: Ultraviolet Absorbing Layer | |
| Gelatin | 0.53 g/m$^2$ |
| Ultraviolet Absorbent (UV-1) | 0.21 g/m$^2$ |
| Solvent (Solv-3) | 0.08 g/m$^2$ |
| Seventh Layer (uppermost layer): Protective Layer | |
| Gelatin | 1.33 g/m$^2$ |
| Acryl-modified Polyvinyl Alcohol Copolymer (modification degree of 17%) | 0.17 g/m$^2$ |
| Liquid Paraffin | 0.03 g/m$^2$ |

As a hardener for these layers, 1-hydroxy-3,5-dichloro-s-triazine sodium salt was used.

The multilayer color photographic paper samples prepared above were processed in the same manner as Example 1. The processing solutions used had the same compositions as in Example 1. After processing, each sample was subjected to the same test as in Example 1.

As a result, excellent photographic characteristics were obtained in Test Nos. 7 to 18 of the present invention.

While the invention has been described in detail and with preference to specific embodiments thereof, it will be apparent to one skilled in the art that various changes and modifications can be made therein without departing from the spirit and scope thereof.

What is claimed is:

1. A method for processing a silver halide color photographic material, which comprises developing said silver halide color photographic material with a color developer that does not contain a substantial amount of benzyl alcohol, said color developer comprising:

(a) an aromatic primary amine color developing agent;

(b) at least one brightening agent represented by formula (I)

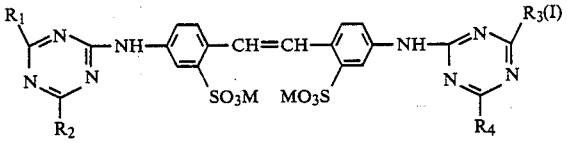

wherein $R_1$, $R_2$, $R_3$ and $R_4$ each represents a hydroxyl group, an alkoxy group, an amino group, an alkylamino group, an aryloxy group or an arylamino group; provided that $R_1$ is not the same as $R_3$ when $R_2$ is the same as $R_4$, and $R_1$ is not the same as $R_4$ when $R_2$ is the same as $R_3$; and M represents a monovalent cation; and (c) at least one organic phosphonic acid series chelating agent.

2. A method for processing a silver halide color photographic material as in claim 1, wherein the color developer does not contain any benzyl alcohol.

3. A method for processing a silver halide color photographic material as in claim 1, wherein the photographic material comprises a silver halide grain emulsion containing 80 mol % or more silver halide grains.

4. A method for processing a silver halide color photographic material as in claim 1, wherein the brightening agent of formula (I) is present in an amount of from 0.1 to 20 g per liter of color developer.

5. A method for processing a silver halide color photographic material as in claim 4, wherein the brightening agent of formula (I) is present in an amount of from 0.5 to 10 g per liter of color developer.

6. A method of processing a silver halide color photographic material as in claim 1, wherein the organic phosphonic acid series chelating agent is selected from the group consisting of alkylphosphonic acids, phosphonocarboxylic acids and aminopolyphosphonic acids.

7. A method for processing a silver halide color photographic material as in claim 6, wherein the organic phosphonic acid series chelating agent is selected from the group consisting of compounds represented by the formula (III):

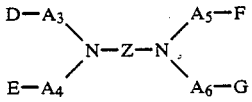

(III)

wherein $A_3$ to $A_6$ each represents a substituted or unsubstituted alkylene group; Z represents an alkylene group, a cyclohexylene group, a phenylene group, —E—O—R—, —R—O—R—O—R—,

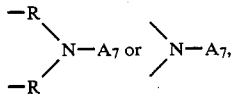

wherein R represents an alkylene group and $A_7$ represents a hydrogen atom, a hydrocarbon residual group, a lower aliphatic carboxylic acid residual group or a lower alcohol residual group; D, E, F and G each represents —OH, —COOM' or —$PO_3M'_2$, wherein M' represents a hydrogen atom, an alkali metal or an ammonium group, and at least one of D, E, F and G is —$PO_3M'_2$.

8. A method for processing a silver halide color photographic material as in claim 1, wherein the organic phosphonic acid series chelating agent is present in an amount of from 0.1 to 40 g per liter of color developer.

9. A method for processing a silver halide color photographic material as in claim 8, wherein the organic phosphonic acid series chelating agent is present in an amount of from 0.2 to 10 g per liter of color developer.

10. A method for processing a silver halide color photographic material as in claim 1, wherein the photographic material contains at least one cyan coupler represented by the formula (XI):

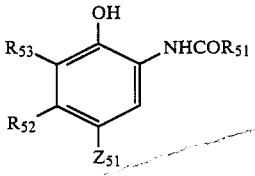

(XI)

wherein $R_{51}$ represents an alkyl group, a cycloalkyl group, an alkenyl group, an aryl group, a substituted or unsubstituted amino group or a heterocyclic group;

$R_{52}$ represents an acylamino group or an alkyl group having 2 or more carbon atoms;

$R_{53}$ represents a hydrogen atom, a halogen atom, an alkyl group or an alkoxy group;

$R_{53}$ may be bonded to $R_{52}$ to form a ring;

$R_{51}$ represents atom, a halogen atom or a group capable of being released by a reaction with the oxidation product of an aromatic primary amine color developing agent.

11. A method for processing a silver halide color photographic material as in claim 1, wherein the aromatic primary amine color developing agent is a p-phenylenediamine derivative.

12. A method for processing a silver halide color photographic material as in claim 11, wherein the aromatic primary amine color developing agent is 4-amino-3-methyl-N-ethyl-N-[β-(methanesulfonamido)ethyl-]aniline.

13. A color developer composition that does not contain a substantial amount of benzyl alcohol, said composition comprising:

(a) an aromatic primary amine color developing agent;

(b) at least one brightening agent represented by formula (I)

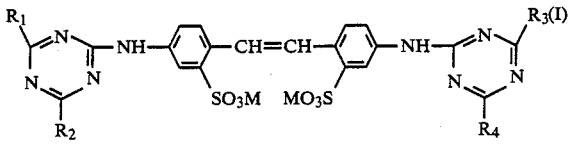

wherein $R_1$, $R_2$, $R_3$ and $R_4$ each represents a hydroxyl group, an alkoxy group, an amino group, an alkylamino group, an aryloxy group or an arylamino group; provided that $R_1$ is not the same as $R_3$ when $R_2$ is the same as $R_4$, and $R_1$ is not the same as $R_4$ when $R_2$ is the same as $R_3$; and M represents a monovalent cation; and (c) at least one organic phosphonic acid series chelating agent.

14. A color developer composition as in claim 13, wherein the organic phosphonic acid series chelating agent is selected from the group consisting of alkylphosphonic acids, phosphonocarboxylic acids and aminopolyphosphonic acids.

15. A color developer composition as in claim 13, wherein the organic phosphonic acid series chelating agent is selected from the group consisting of compounds represented by the formula (III):

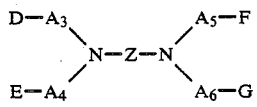

(III)

wherein $A_3$ to $A_6$ each represents a substituted or unsubstituted alkylene group; Z represents an alkylene group, a cyclohexylene group, a phenylene group, —R—O—R—, —R—O—R—O—R—,

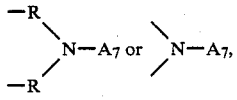

wherein R represents an alkylene group and $A_7$ represents a hydrogen atom, a hydrocarbon residual group, a lower aliphatic carboxylic acid residual group or a lower alcohol residual group; D, E, F and G each represents —OH, —COOM′ or $—PO_3M'_2$, wherein M′ represents a hydrogen atom, an alkali metal or an ammonium group, and at least one of D, E, F and G is $—PO_3M'_2$.

16. A method for processing a silver halide color photographic material as in claim 1, wherein the benzyl alcohol content is 2 ml or less per liter of the color developer.

17. A color developer composition as in claim 13, wherein the benzyl alcohol content is 2 ml or less per liter.

* * * * *